US008607379B2

(12) United States Patent
Yoshie et al.

(10) Patent No.: US 8,607,379 B2
(45) Date of Patent: Dec. 17, 2013

(54) KNOCKDOWN FURNITURE FOR INFANT

(75) Inventors: Toshiro Yoshie, Saitama (JP); Rikimasa Gunji, Taito-ku (JP)

(73) Assignee: COMBI Corporation, Tokyo (JP)

( * ) Notice: Subject to any disclaimer, the term of this patent is extended or adjusted under 35 U.S.C. 154(b) by 191 days.

(21) Appl. No.: 12/518,569

(22) PCT Filed: Dec. 12, 2007

(86) PCT No.: PCT/JP2007/073927

§ 371 (c)(1),
(2), (4) Date: Jul. 30, 2009

(87) PCT Pub. No.: WO2008/078556

PCT Pub. Date: Jul. 3, 2008

(65) Prior Publication Data

US 2010/0017959 A1 Jan. 28, 2010

(30) Foreign Application Priority Data

Dec. 22, 2006 (JP) ..... 2006-346158

(51) Int. Cl.
*A47D 7/00* (2006.01)

(52) U.S. Cl.
USPC ..... 5/99.1; 5/93.1

(58) Field of Classification Search
USPC ..... 5/93.1, 97, 102, 112, 114, 116, 117, 5/655, 93.2, 98.1–99.1, 101
See application file for complete search history.

(56) References Cited

U.S. PATENT DOCUMENTS

| | | | | |
|---|---|---|---|---|
| 5,560,055 | A * | 10/1996 | Ziegler | 5/99.1 |
| 5,644,806 | A * | 7/1997 | Mariol et al. | 5/99.1 |
| 5,761,754 | A * | 6/1998 | Cheng | 5/99.1 |
| 5,778,465 | A * | 7/1998 | Myers | 5/99.1 |
| 6,588,033 | B1 * | 7/2003 | Welsh et al. | 5/99.1 |
| 2003/0061657 | A1 * | 4/2003 | Longenecker et al. | 5/99.1 |
| 2003/0132080 | A1 | 7/2003 | Dababneh | |

FOREIGN PATENT DOCUMENTS

| | | | |
|---|---|---|---|
| CN | 2117793 | U | 10/1992 |
| JP | 3-12724 | Y1 | 12/1899 |
| JP | 5-11206 | Y2 | 3/1993 |
| JP | 3037026 | U | 2/1997 |
| JP | 11-009402 | A | 1/1999 |
| JP | 3093146 | U | 1/2003 |
| JP | 2003-534838 | A | 11/2003 |
| JP | 3125560 | U | 9/2006 |

OTHER PUBLICATIONS

Chinese Office Action corresponding to Chinese Patent Application No. 200780047489.6, dated Jul. 20, 2010.

Japanese Office Action corresponding to Japanese Patent Application No. 2006-346158, dated Dec. 7, 2011.

Taiwanese Office Action corresponding to Taiwanese Patent Application No. 096146411, dated Dec. 25, 2012.

* cited by examiner

*Primary Examiner* — Nicholas Polito
(74) *Attorney, Agent, or Firm* — Sughrue Mion, PLLC

(57) ABSTRACT

Knockdown furniture for an infant, having enhanced folding workability and safety for an infant. The knockdown furniture (1) for an infant has a frame (11) which forms a space for receiving an infant, and the frame (11) is provided with frame members (30, 40, 50) and a bottom plate (60) placed below the frame members (30, 40, 50). The frame members (30, 40, 50) can be folded into a flat shape lying along the bottom plate (60), and the frame members (30, 40, 50), which are folded into the flat shape lying along the bottom plate (60), and the bottom plate (60) can be integrally folded on each other.

13 Claims, 25 Drawing Sheets

KNOCKDOWN FURNITURE FOR INFANT

CROSS REFERENCE TO RELATED APPLICATION

This application is a 371 National Phase of PCT/JP2007/073927 filed Dec. 12, 2007, claiming the priority of Japanese Patent Application No. 2006-346158 filed Dec. 22, 2006, the disclosures of which are hereby incorporated by reference.

TECHNICAL FIELD

The present invention relates to knockdown furniture for an infant that forms a playing space or a sleeping space for an infant.

BACKGROUND ART

Conventionally, there has been proposed knockdown furniture for an infant (play yard, play pen) that forms a sleeping space or a playing space for an infant. The knockdown furniture for an infant includes a hollow rectangular parallelepiped main body, and only an upper surface of the main body is opened. An infant can be placed into the main body from the opened upper surface, and the infant is surrounded by the main body and is safely protected. A flat bed plate can be attached in the main body in a suspended manner, and the infant can be laid down on the upper surface of the bed plate. Further, when the knockdown furniture for an infant is not used, it can be folded and stored. When the knockdown furniture is to be used, it can be assembled and used. In this way, the knockdown furniture for an infant has an advantage such that both a playing space and a sleeping space for an infant can be easily formed, and when it is not used, it can be folded and a space for installing the knockdown furniture can be effectively utilized.

A specific structure for such conventional knockdown furniture for an infant is explained below. That is, a rectangular parallelepiped main body includes four vertical frames, four upper lateral frames connected to upper portions of the vertical frames, and four lower lateral frames connected to lower portions of the vertical frames. Side sheets are provided between adjacent vertical frames, and a bottom plate is provided between the lower lateral frames.

A central portion of each upper lateral frame in its longitudinal direction can be folded downward. Therefore, when the knockdown furniture for an infant is not used, a bottom plate is first detached from the main body, the upper lateral frames are folded downward from their central portions, thereby collecting the four vertical frames to a central position as viewed from above, and the knockdown furniture for an infant can be folded. Further, when the knockdown furniture for an infant is to be used, the vertical frame is pushed and spread laterally outward, the central portion of each upper lateral frame is brought upward and is returned straightly, and the bottom plate can be attached to the main body (see Patent Document 1, for example).

Patent Document 1: U.S. Pat. No. 7,043,779 Specification

SUMMARY OF THE INVENTION

According to such conventional knockdown furniture for an infant, however, when it is folded, it is necessary to detach the bottom plate from the main body, whereas when it is to be assembled, it is necessary to attach the bottom plate to the main body. Therefore, it is necessary to take some time to fold and assemble the knockdown furniture. Further, because the four vertical frames are collected to the central portion, there is an adverse possibility that an infant is caught between the vertical frames.

The present invention has been achieved in view of the above circumstances, and an object of the present invention is to provide knockdown furniture for an infant capable of enhancing its folding workability and safety for an infant.

To achieve the above object, the knockdown furniture for an infant according to the present invention is configured as follows. Some of reference numerals of constituent elements, which are explained in embodiments of the present invention described below, are exemplified in parenthesis. However, these reference numerals are only exemplary, and constituent elements not represented by reference numerals in parenthesis among those explained in the embodiments or other constituent elements not explained in the embodiments can also correspond to the constituent elements of the present invention.

Knockdown furniture for an infant (1) includes a frame body (11, 100, 200) that forms an accommodating space in which an infant is accommodated, the frame body includes a plurality of frame members (30, 110, 310, 40, 41, 120, 121, 320, 321, 50, 51, 130, 330, 331), and a bottom plate (60, 340) arranged below the frame body, the plurality of frame members can be folded into a flat shape along the bottom plate, and the bottom plate and the plurality of frame members folded into a flat shape along the bottom plate can be mutually and integrally folded.

According to the present invention, because the knockdown furniture for an infant can be folded without detaching the bottom plate, it is possible to remarkably easily fold the knockdown furniture for an infant. Conversely, when the knockdown furniture for an infant is to be assembled, because it is unnecessary to attach the bottom plate, the knockdown furniture for an infant can be remarkably easily assembled. The plurality of frame members and the bottom plate are integrally folded into a flat shape, and the frame members are not collected to the central position unlike the conventional technique. Therefore, the risk of an infant being caught between the frame members is reduced and safety can be enhanced.

As a more specific structure for obtaining such an effect, the plurality of frame members constituting the frame body (11, 100, 200) include a plurality of vertical frames (30, 110, 310), an upper lateral frame (40, 41, 120, 121, 320, 321) arranged on upper portions of the vertical frames, and a lower lateral frame (50, 51, 130, 330, 331) arranged on lower portions of the plurality of vertical frames, the upper lateral frame, the lower lateral frame, and the bottom plate are arranged substantially in parallel to each other, the vertical frame includes a first folding unit (31, 111, 311) that arranges the upper lateral frame, the lower lateral frame, and the bottom plate at positions close to each other while maintaining them in parallel to each other by making it possible to fold the vertical frame, and a second folding unit (42, 52, 61, 122, 132, 141, 322, 332, 341) are provided at positions substantially corresponding to the upper lateral frame, the lower lateral frame, and the bottom plate by making it possible to fold the upper lateral frame, the lower lateral frame, and the bottom plate substantially in the same direction.

According to the present invention, by folding the vertical frames by the first folding unit, the upper lateral frame, the lower lateral frame, and the bottom plate can be arranged substantially in parallel to each other, and the upper lateral frame, the lower lateral frame, and the bottom plate can be integrally folded by the second folding unit.

Alternatively, the first folding unit (31, 111, 311) of the vertical frame (30, 110, 310) can be arranged substantially at the central position of the vertical frame in its longitudinal direction.

According to the present invention, in a state where the vertical frame is folded, the vertical frame can be folded into two at vertically substantially equal lengths around the first folding unit, and the vertical frame can be folded most compactly. Further, if the vertical frame is folded at vertically substantially equal lengths in this manner, the upper lateral frame can be arranged above the lower lateral frame while keeping the flat shape of the upper lateral frame.

In the present invention, an operating unit (53) of the lower lateral frame (50) can be held from above, the central frame (44) of the upper lateral frame (40) and the central surface (63) of the bottom plate (60) are arranged above the operating unit (53), and the operating unit of the lower lateral frame is brought up and folded. With this configuration, the upper lateral frame and the bottom plate can be made collectively foldable.

According to the present invention, the upper lateral frame and the bottom plate can be collectively folded in association with each other by a single motion, that is, by bringing up the operating unit of the lower lateral frame, and a folding operation can be performed more easily.

In the present invention, an opening (63*a*) that can open and close can be formed in the bottom plate (60), the operating unit (53) of the lower lateral frame (50) can be arranged below the opening, and the operating unit of the lower lateral frame can be made holdable from above through the opening.

According to the present invention, the operating unit of the lower lateral frame can be held through the opening of the bottom plate, the operating unit can be brought up and a folding operation can be performed. Therefore, the folding operation can be easily performed without detaching the bottom plate.

In the present invention, the operating unit (53) of the lower lateral frame (50) can be provided with an operating handle (55) that performs the folding operation of the lower lateral frame and that holds the knockdown furniture for an infant (1) in a folded manner.

According to the present invention, the lateral frame can be folded using the operating handle, and the knockdown furniture for an infant in a folded manner can be easily handled using the operating handle.

Further, a bed plate (20) on which an infant is laid down can be detachably attached to the frame (11).

According to the present invention, an infant is put on the bed plate attached to the frame, and thus the infant can lie down safely. Further, the bed plate can be detached from the frame when unnecessary.

The bed plate (400) can be made foldable in a flat shape along the bottom plate (60).

According to the present invention, when the knockdown furniture for an infant is folded, the bed plate can be folded along the bottom plate (60) and thus it is unnecessary to detach the bed plate.

Further, the bed plate (20) can be provided with a protection cover (23) that can surround an infant.

According to the present invention, the protection cover surrounds an infant and it is possible to more safely protect the infant.

Rollers (72) that can move the knockdown furniture for an infant (1) can be provided below the frame (11).

According to the present invention, the knockdown furniture for an infant can be easily moved using the rollers.

Further, the frame (11) can be provided with a moving handle (56) for pulling and rotating the knockdown furniture for an infant (1).

According to the present invention, the knockdown furniture for an infant can be easily pulled and rotated using the moving handle.

Further, the moving handle (56) can be stored in the frame (11) such that the moving handle can be taken out.

According to the present invention, because the moving handle can be taken out from the frame when necessary and can be stored in the frame when unnecessary, the convenience of the moving handle can be enhanced.

Further, a moving handle (500) can be made detachable from the frame (11).

According to the present invention, the moving handle can be attached only when necessary, the moving handle can be detached when unnecessary and thus its handling is further facilitated.

The moving handle (56) can be provided with an extension and retraction mechanism that can extend and retract the moving handle.

According to the present invention, the moving handle can be extended when necessary and can be retracted and stored in the frame when unnecessary. Therefore, the convenience of the moving handle can further be enhanced.

According to the present invention, because the knockdown furniture for an infant can be folded without detaching the bottom plate, it can be folded remarkably easily. Conversely, when the knockdown furniture for the infant is to be assembled, because it is unnecessary to attach the bottom plate, it can be assembled considerably easily. Further, the plurality of flat frame members and the bottom plate are integrally folded and the frame members are not collected to the central position unlike the conventional technique, and thus the probability that an infant is caught between the frame members can be lowered, and the safety can be enhanced. Particularly, the upper lateral frames and the bottom plate can be folded in an associated manner with a single motion, that is, pushing up the operating unit of the lower lateral frame, and the folding operation is further facilitated. Further, the operating unit of the lower lateral frame can be held through the opening of the bottom plate, and the folding operation can be performed by bringing up the operating unit. Therefore, the folding operation can be easily performed without detaching the bottom plate.

EXPLANATIONS OF REFERENCE NUMERALS

Figure 1:
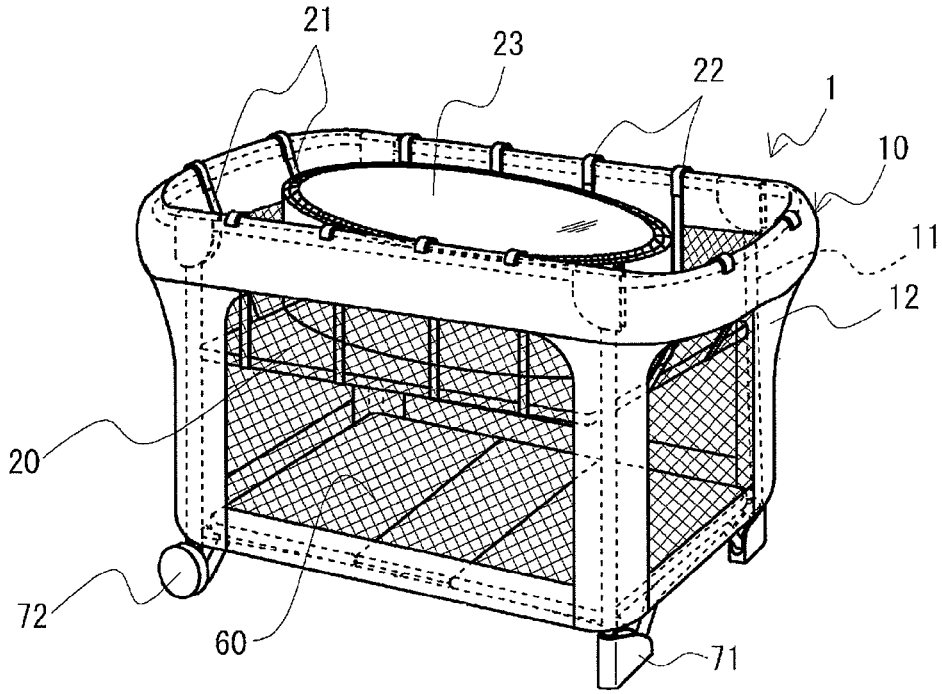
FIG. 1 is an entire perspective view of a using state of knockdown furniture for an infant according to a first embodiment of the present invention.

1 knockdown furniture for an infant
10 furniture main body
11, 100, 200, 401 frame
12 frame cover
20, 400 bed plate
21 connection belt
22, 401*a* hook
23 protection cover
24 open/close unit
30, 110, 310 vertical frame
31, 111, 311 first folding unit
32 upper main tube
32*a*, 35*a*, 36*a* screw hole
33 lower main tube
34 connection stay
35 operation tube
36 operation stay
37, 45 connection screw
38, 59 spiral screw
40, 41, 120, 121, 320, 321 upper lateral frame
42, 52, 61, 122, 132, 141, 322, 332, 341 second folding unit
43, 123, 133, 323 side frame
44, 124, 134, 323 central frame
50, 51, 130, 330, 331 lower lateral frame
50*a* hole
53 operating unit
53*a* space
54 casing
54*a* upper casing
54*b* lower casing
55 operating handle
56, 500 moving handle
57 rotation disc
57*a* projection
58 fitting rod
60, 140, 340, 403 bottom plate
62, 142 side surface
63, 143 central surface
63*a* opening
63*b* through hole
64 open/close surface
70, 71, 150, 340, 341 connecting unit
72 roller
131 lower central frame
400 diaper changing sheet
401*b* hinge
402 side sheet
403*a* division line
502 attaching hole
503 rod
504 connecting rod
505 attaching and detaching mechanism
505*a* rotation shaft
505*b* operation knob
505*c* engaging unit

BEST MODES FOR CARRYING OUT THE INVENTION

Embodiments of knockdown furniture for an infant according to the present invention will be explained below in detail with reference to the accompanying drawings. Note that the present invention is not limited to the embodiments.

[First Embodiment]

Knockdown furniture for an infant according to a first embodiment is explained first. According to this embodiment, a plurality of frame members can be folded in a flat shape along a bottom plate, and the frame members can be integrally folded.

(Entire Structure of Knockdown Furniture For An Infant)

First, the entire structure of the knockdown furniture for an infant is explained. FIG. 1 is an entire perspective view in a using state of the knockdown furniture for an infant. Knockdown furniture for an infant 1 includes a furniture main body 10 and a bed plate 20.

The furniture main body 10 is a base structure of the knockdown furniture for an infant 1, and is formed into a hollow rectangular parallelepiped as a whole, and has a sufficient space for accommodating an infant therein. The furniture main body 10 includes a frame 11 that is a frame body, and a frame cover 12 covering the frame 11.

Each surface of the frame 11 is basically opened, its side surface is provided with the frame cover 12, a later-described bottom plate 60 is laid down on a bottom surface of the frame 11, thereby forming the side surface and the bottom surface into a closed loop. This structure forms such a protection environment that an infant accommodated in the furniture main body 10 does not go out from the furniture unintentionally.

While the specific structure of the frame cover 12 is not limited, it is a flat cloth or a mesh cloth. An end of the frame cover 12 is wound around the frame cover 12, and a winding end is fixed to the frame 11 such that the winding end can be detached by sewn fixing means or fixing means such as a fastener or buttons. Because the frame cover 12 can be the same as the conventional frame cover except specifically described parts, explanations of the frame cover 12 will be omitted below.

Figure 2:
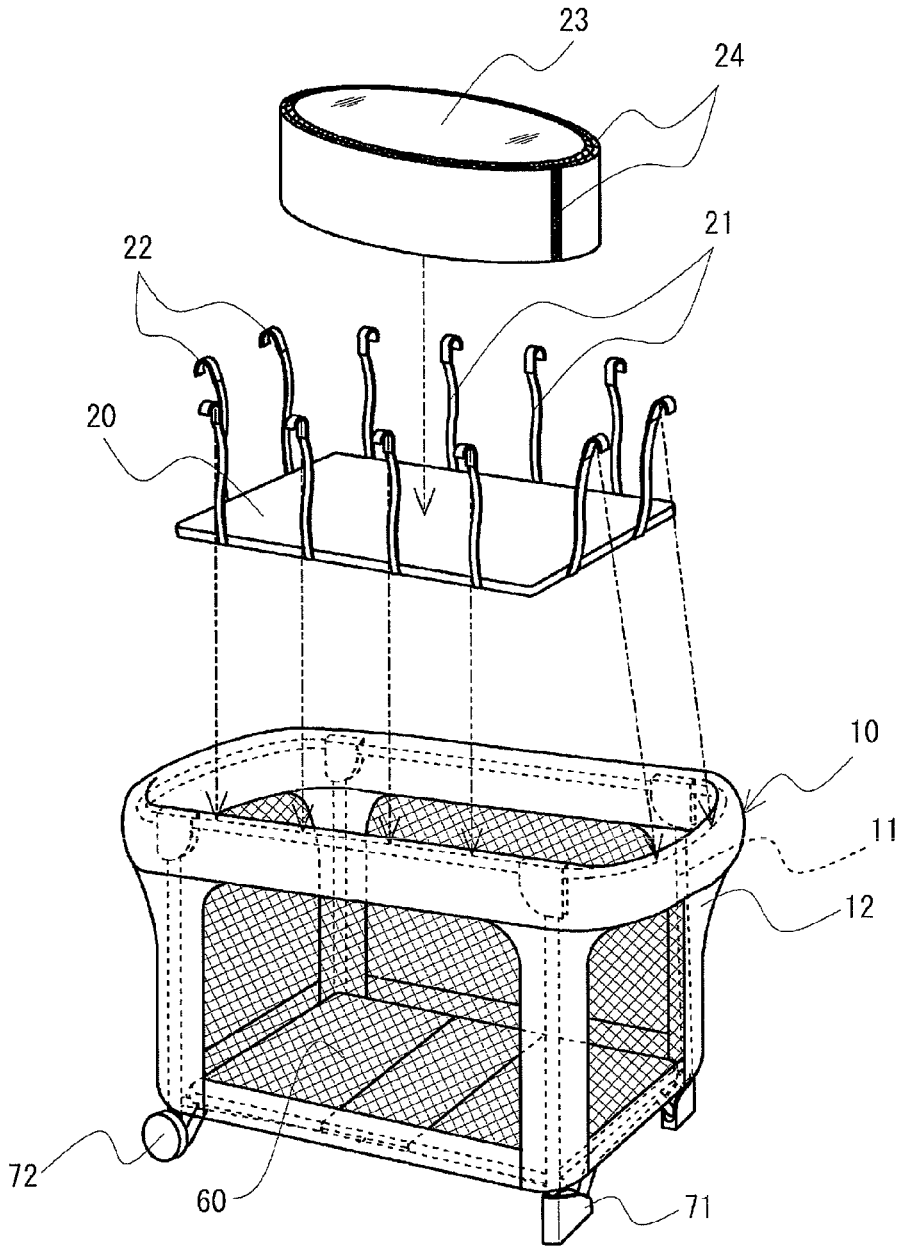
FIG. 2 is an exploded perspective view of the knockdown furniture for an infant from which a bed plate is detached.

The bed plate 20 forms a flat surface for laying an infant on the upper surface, and the bed plate 20 is detachably attached to the furniture main body 10. FIG. 2 is an exploded perspective view of the knockdown furniture for an infant 1 from which the bed plate 20 is detached. The bed plate 20 is formed into a flat (for example, rectangular) plate shape like the furniture main body 10.

The bed plate 20 is provided at its periphery with a plurality of connection belts 21, and the connection belts 21 are provided at their upper ends with hooks 22. The bed plate 20 is inserted into the furniture main body 10 from the opened upper surface, and the hooks 22 are detachably engaged with the frame 11. With this configuration, the bed plate 20 can be detachably suspended in the furniture main body 10. When the bed plate 20 is unnecessary (when it is desired to accommodate an infant in the space in the frame 11) or when it is desired to fold the knockdown furniture for an infant 1, the bed plate 20 can be easily detached from the furniture main body 10 following the attaching steps in reverse.

A protection cover 23 is placed on the bed plate 20. The protection cover 23 surrounds an infant on the upper surface of the bed plate 20 to protect the infant. The protection cover 23 is formed into a rectangular parallelepiped (for example, a short hollow cylindrical shape that is suitable to an average body shape of an infant) suitable for accommodating the infant. Open/close units 24 including fasteners are provided at an upper surface peripheral edge and a side surface of the protection cover 23. The open/close units 24 are opened and closed, and an infant can be laid down in the protection cover 23. While the material of the protection cover 23 is not limited, a flexible material is preferred and a urethane pad can be used. Although the protection cover 23 is placed on the bed plate 20 here, the connection belts 21 can be directly attached around the protection cover 23, and the protection cover 23 can be engaged directly with the frame 11.

(Outline of Folding Structure of Knockdown Furniture For An Infant 1)

Figure 3:
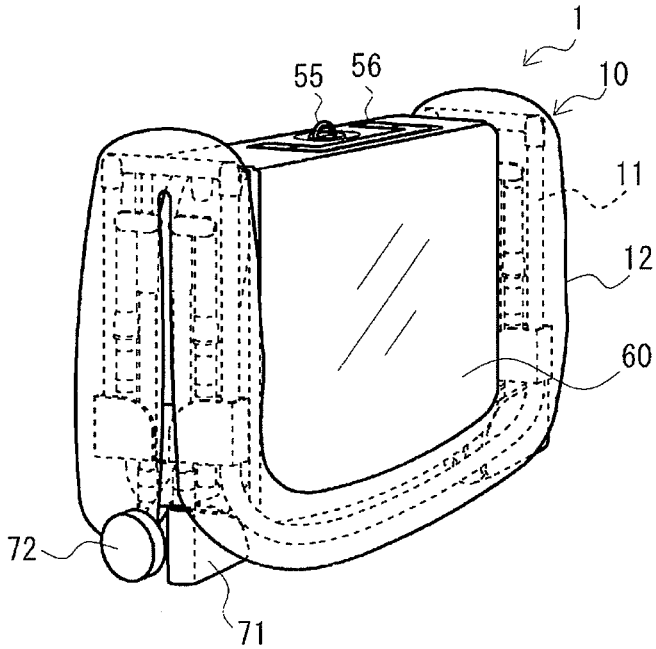
FIG. 3 is an entire perspective view of a main body of the furniture in its folded state.
Figure 4:
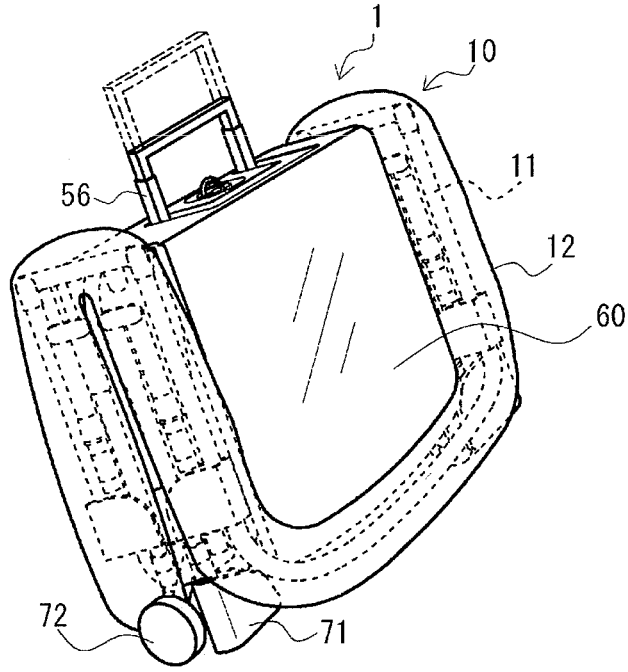
FIG. 4 is an entire perspective view showing a moving state of the furniture main body shown in FIG. 3.
Figure 5:
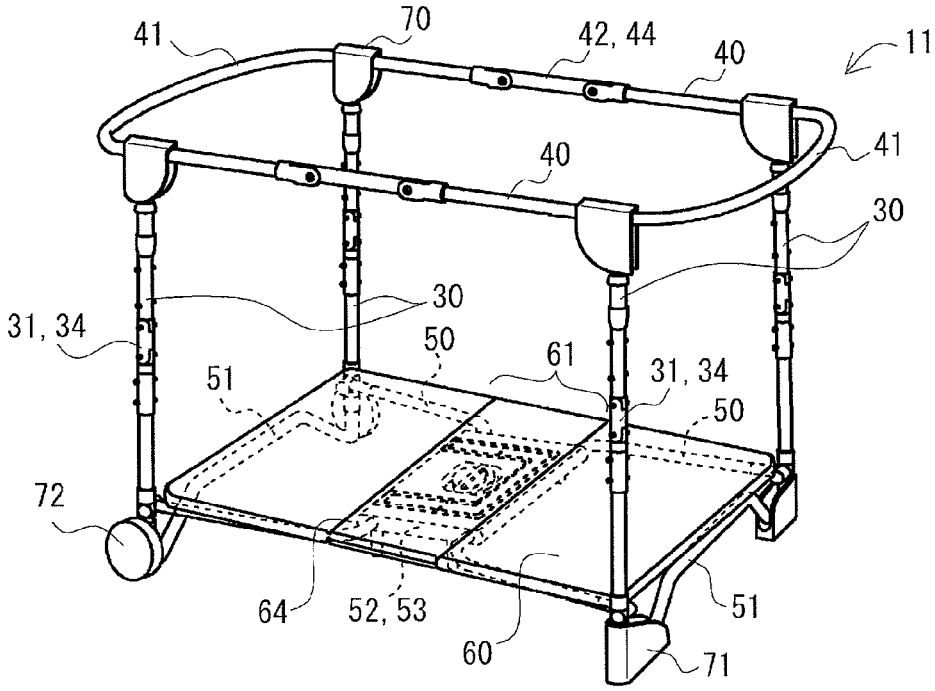
FIG. 5 is an entire perspective view of frames.
Figure 6:
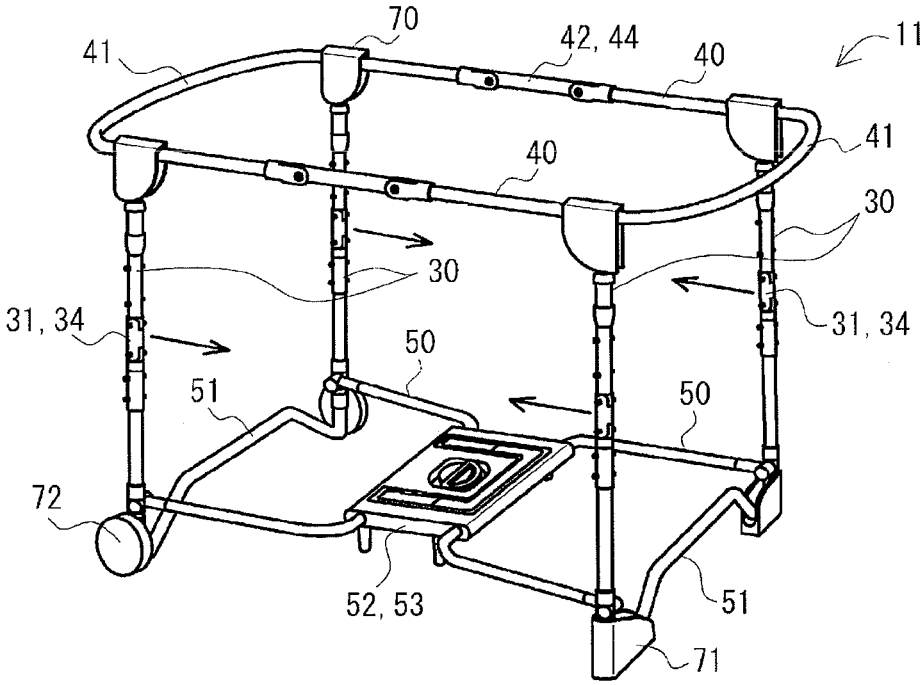
FIG. 6 is an entire perspective view of the frames in a state where a bottom plate is detached.
Figure 7:
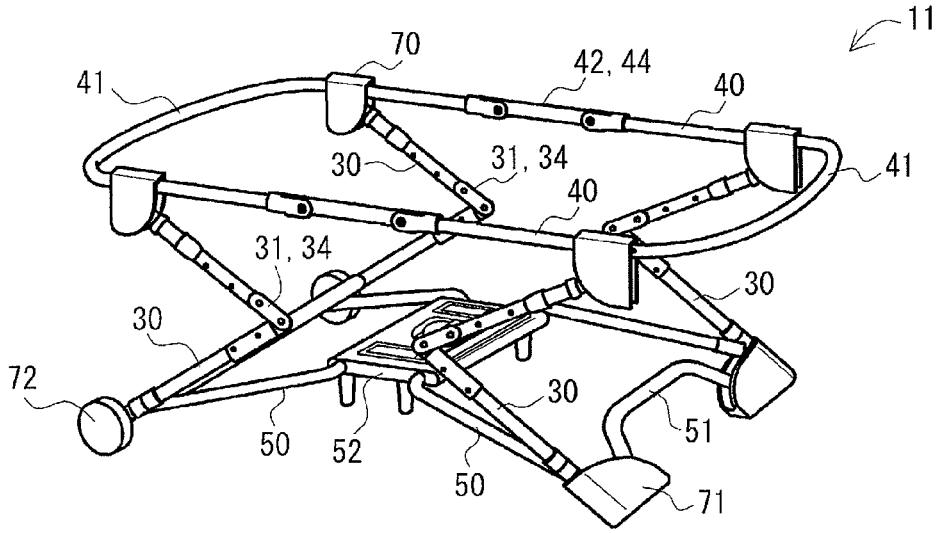
FIG. 7 is an entire perspective view of the frames in a state where the frames are being folded.
Figure 8:
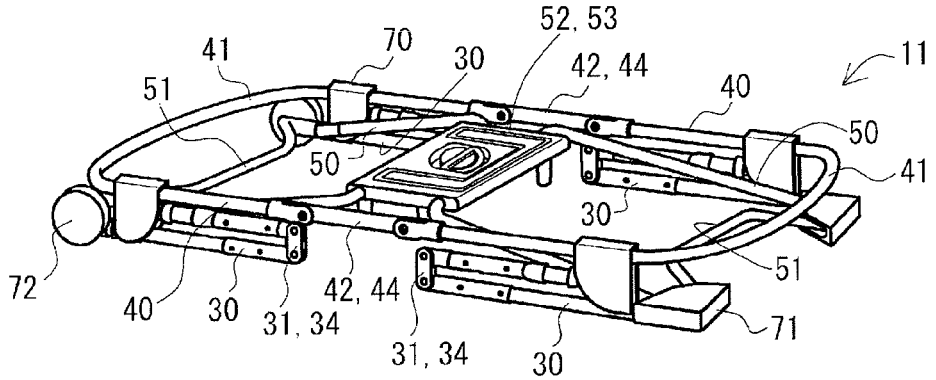
FIG. 8 is an entire perspective view of the frame in a state where the frames are being folded.
Figure 9:
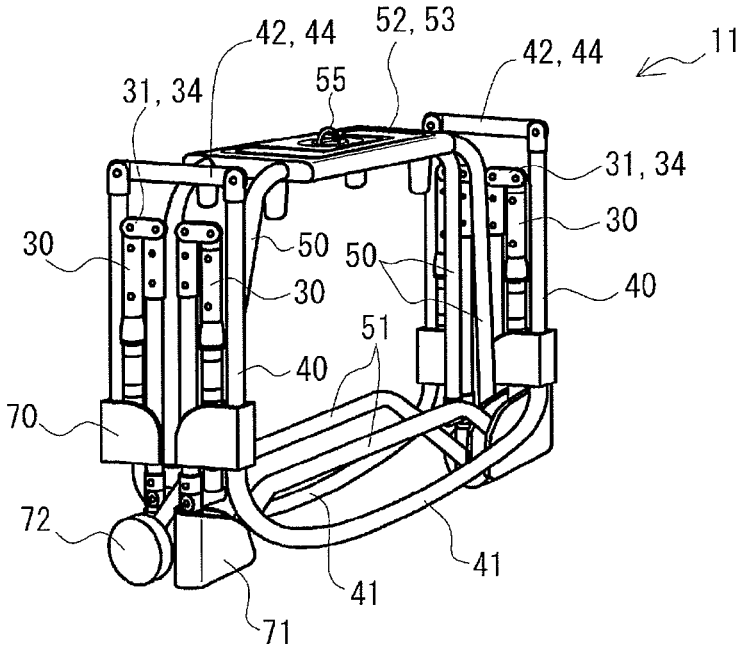
FIG. 9 is an entire perspective view of the frames in a state where the frames are folded.

Details of an outline of a folding structure of the furniture main body 10 are explained next. FIG. 3 is an entire perspective view of the furniture main body 10 in its folded state, FIG. 4 is an entire perspective view showing a moving state of the furniture main body 10, FIG. 5 is an entire perspective view of the frame 11, FIG. 6 is an entire perspective view of the frame 11 in a state where the bottom plate 60 is detached, FIGS. 7 and 8 are entire perspective views of the frame 11 in a state where the frame 11 is being folded, and FIG. 9 is an entire perspective view of the frame 11 in its folded state. FIG. 5 shows a state where the frame cover 12 is detached. FIGS. 6 to 9 show a state where the frame cover 12 and the bottom plate 60 are detached.

As shown in FIG. 5 to 9, the frame 11 according to the first embodiment includes four vertical frames 30 arranged at a distance from each other, four upper lateral frames 40 and 41 arranged at upper portions of the vertical frames 30, four lower lateral frames 50 and 51 arranged at lower portions of the vertical frames 30, and the bottom plate 60 laid above the lower lateral frames 50 and 51. The vertical frames 30, the upper lateral frames 40 and 41 and the lower lateral frames 50 and 51 are formed into rod-like shape, and they are arranged at positions corresponding to vertical sides, upper lateral sides and lower lateral sides of the parallelepiped frame 11. The bottom plate 60 is formed into a flat-plate shape that is suited to a flat shape (rectangular) of the frame 11, and is arranged at a position corresponding to a bottom surface of the parallelepiped frame 11. As is apparent from these constitutions, the upper lateral frames 40 and 41, the lower lateral frames 50 and 51 and the bottom plate 60 are arranged in parallel to each other.

Each of the vertical frame 30 is provided with a first folding unit 31 at its substantially central position in its longitudinal direction. The upper lateral frame 40, the lower lateral frame 50, and the bottom plate 60 are provided with second folding units 42, 52, and 61, respectively, at their substantially central positions in the longitudinal direction. The first folding unit 31 corresponds to a first folding unit, and the second folding units 42, 52, and 61 correspond to a second folding unit. Specific functions and structures of the first folding unit 31 and the second folding units 42, 52, and 61 will be described later.

Each of the vertical frame 30 and the upper lateral frames 40 and 41 are connected to each other through a connecting unit 70. Each of the connecting unit 70 incorporates a known turning mechanism (not shown) therein, and the vertical frame 30 can turn with respect to the connecting unit 70. The lower lateral frame 50 is turnably supported near a lower end of the vertical frame 30. The vertical frame 30 and the lower lateral frame 51 are fixed and connected to each other through connecting units 71, and the vertical frame 30 and one of the lower lateral frames 51 are connected to rollers 72.

In such a structure, a state shown in FIG. 7 can be established by folding the vertical frames 30 in predetermined folding directions (the directions indicated by the arrows in FIG. 6 and in the center direction in a plane in a side surface of the parallelepiped formed by the frame 11 on a wider side). In this state, each of the vertical frame 30 is inclined while turning with respect to the connecting unit 70 and the lower lateral frame 50, and is moved downward while maintaining the upper lateral frames 40 and 41 in the flat shape and the vertical frame 30 comes close to the lower lateral frames 50 and 51, and finally achieves the state shown in FIG. 8. In this state, the vertical frame 30, the upper lateral frames 40 and 41 and the lower lateral frames 50 and 51 are superposed on each other, and the frame 11 is filed into a single flat body as a whole. Thereafter, the second folding unit 52 of the lower lateral frame 50 is brought up, thereby turning the lower lateral frame 50 with respect to the second folding unit 52, the upper lateral frame 40 is folded by the second folding unit 42, and the state shown in FIG. 9 is established. Therefore, the knockdown furniture for an infant 1 can be folded in a single flat plate (or a thin rectangular parallelepiped) that stands on a floor surface, and the knockdown furniture for an infant 1 can be made compact and stored in a narrow space.

Figure 10:
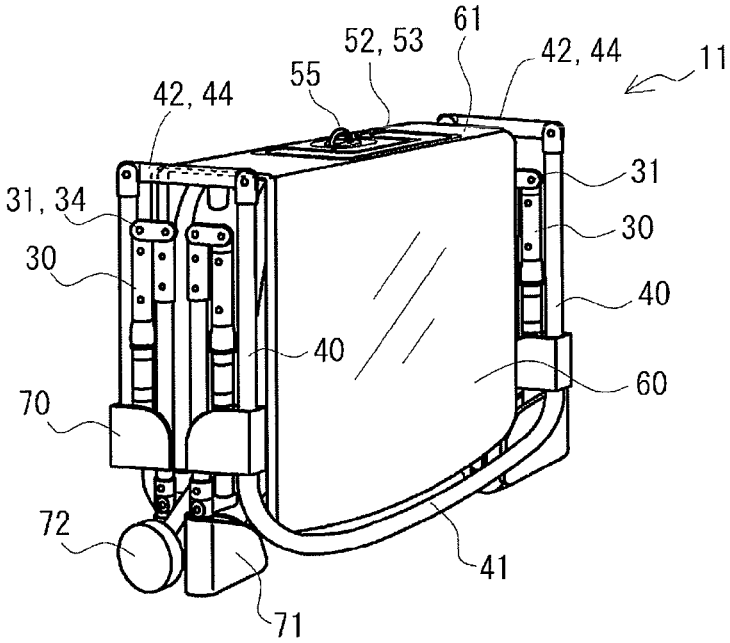
FIG. 10 is an entire perspective view of the frames in a state where the frames are folded together with the bottom plate.

As described above, FIG. 5 shows a state where the frame cover 12 is detached, and FIGS. 6 to 9 show a state where the frame cover 12 and the bottom plate 60 are detached. However, in practice, the frame is folded in a state where the frame cover 12 and the bottom plate 60 are attached. That is, in practice, in a state shown in FIG. 8, the bottom plate 60 is sandwiched between the upper lateral frames 40 and 41 and the lower lateral frames 50 and 51, and the frame 11 including the bottom plate 60 is folded into a single substantially flat plate body as a whole. As described above, the bottom plate 60 is folded at the second folding unit 61 together with the upper lateral frames 40 and 41 by bringing up the second folding unit 52 of the lower lateral frame 50, and the state shown in FIG. 10 is established.

(Details of Folding Structure of Knockdown Furniture For An Infant 1)

Structures of parts that make possible to fold are described next in detail. Note that the folding structures of each part are not limited to those explained below unless otherwise specified, and these structures can be replaced by known structures having substantially the same functions.

Figure 11:
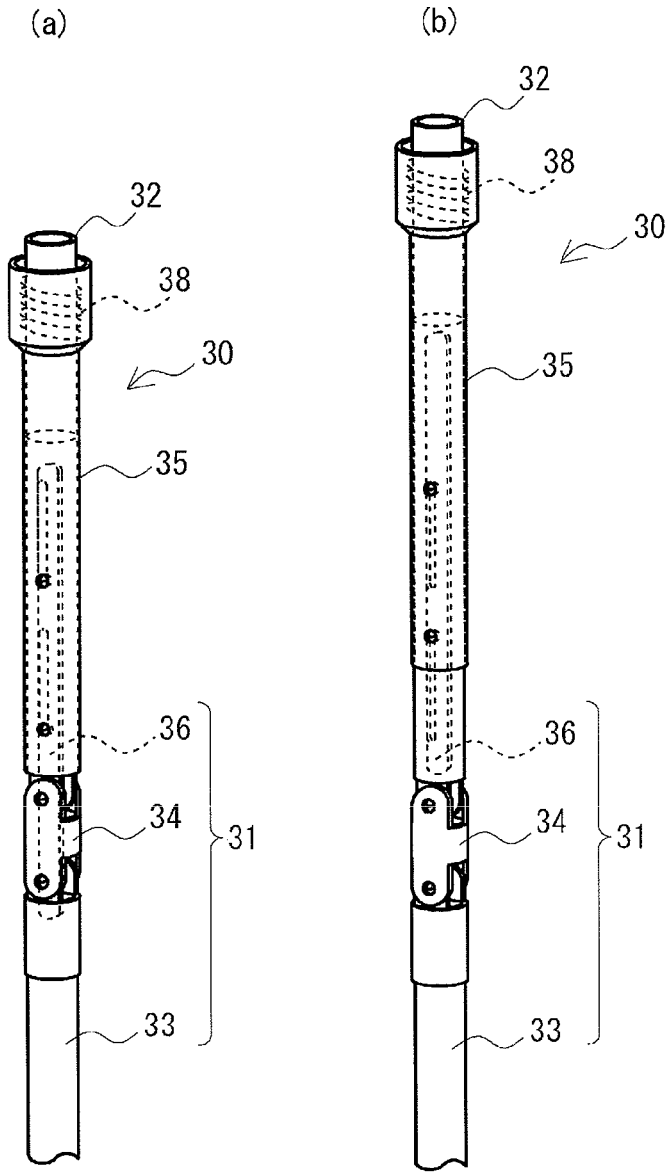
FIG. 11 are enlarged perspective views of relevant parts of a vertical frame, where (a) shows a state before folding, and (b) shows a state where the frame can be folded.
Figure 12:
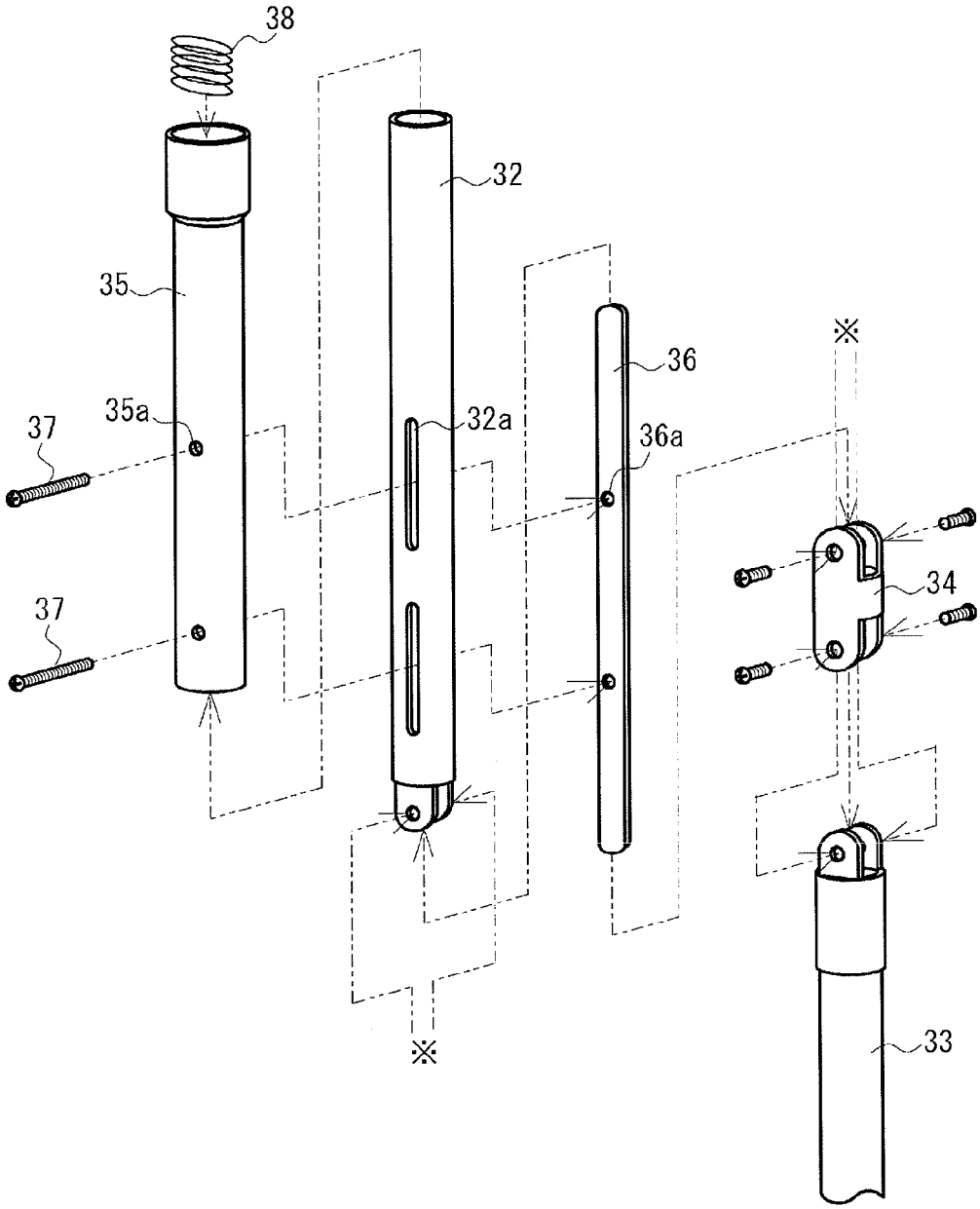
FIG. 12 is an exploded perspective view of relevant parts of the vertical frame.

First, a folding structure of the vertical frame 30 is explained. FIG. 11 are enlarged perspective views of relevant parts of the vertical frame 30, where (a) shows a state before folding and (b) shows a state where the frame can be folded. FIG. 12 is an exploded perspective view of relevant parts of the vertical frame 30. The vertical frame 30 is vertically divided into two pieces, that is, an upper main tube 32 and a lower main tube 33. The upper main tube 32 and the lower main tube 33 are connected to each other such that they can turn with respect to a connection stay 34 arranged therebetween. An operation tube 35 is arranged outside of the upper main tube 32, and an operation stay 36 is arranged inside of the upper main tube 32 along a longitudinal direction of the upper main tube 32. The operation tube 35 and the operation stay 36 are arranged concentrically with the upper main tube 32. The connection stay 34, the operation tube 35 and the operation stay 36 constitute the first folding unit 31 of the vertical frame 30.

The upper main tube 32, the operation tube 35 and the operation stay 36 are formed with screw holes 32*a*, 35*a*, and 36*a*, respectively, and a common connection screw 37 is threadedly inserted into the screw holes 32*a*, 35*a*, and 36*a*. The screw hole 32*a* formed in the upper main tube 32 is a long hold extending along the longitudinal direction of the upper main tube 32. Therefore, if the operation tube 35 is vertically moved, the upper main tube 32 is not moved in association with this motion and stays at the same position, and only the operation stay 36 is vertically moved in association with the operation tube 35 through the connection screw 37. In the initial position, the operation stay 36 extends through a hollow portion of the connection stay 34 and extends to the upper end of the lower main tube 33. In this state, the operation stay 36 functions as a core, restricts the turning motion of the upper main tube 32 and the lower main tube 33 with respect to the connection stay 34, and the standing state of the vertical frame 30 is maintained as shown in FIG. 6.

Meanwhile, if the operation tube 35 is held and slid upward, the connection stay 34 is slid upward together with this motion, and the connection stay 34 is pulled out from the connection stay 34 and the lower main tube 33. Therefore, the upper main tube 32 and the lower main tube 33 can turn with respect to the connection stay 34. In this state, if the vertical frame 30 is pressed in the directions indicated by the arrows in FIG. 6, the vertical frame 30 can be folded substantially into two around the connection stay 34. In FIGS. 11 and 12, the upper end of the operation tube 35 is increased in width and formed into a bag-like shape. A spiral screw 38 that is substantially concentric with the upper main tube 32 is arranged in a space of the bag-like shape. The operation tube 35 is biased downward by the spiral screw 38, and in a state where a user releases her hand from the operation tube 35, the operation tube 35 is maintained in its initial position.

Figure 13:
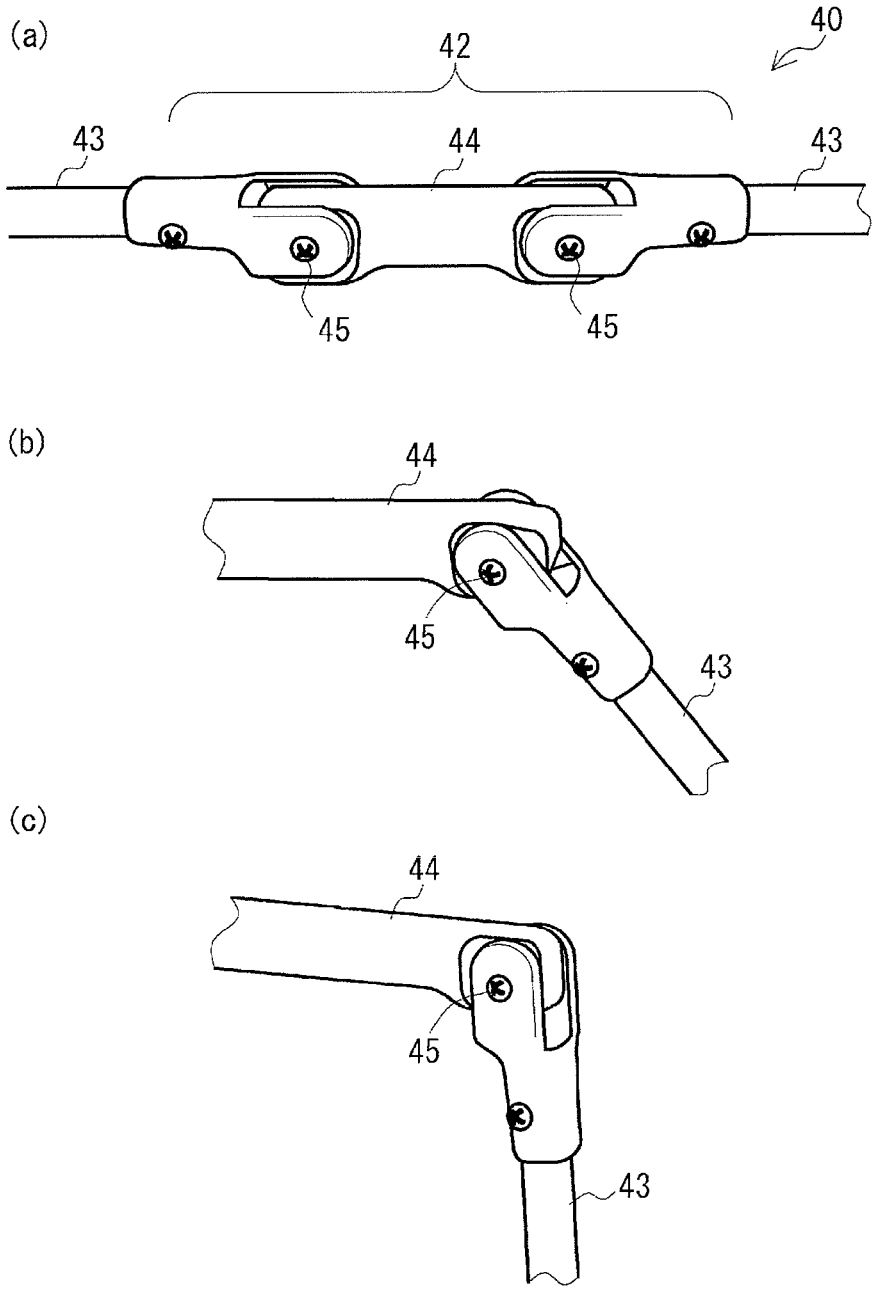
FIG. 13 are enlarged perspective views around an end of a second folding unit of an upper lateral frame, where (a) shows a state before folding, (b) shows a state where the frame is being folded, and (c) shows a state after folding.

A folding structure of the upper lateral frame 40 is explained next. FIG. 13 are enlarged perspective views of an end of the second folding unit 42, where (a) shows a state before folding, (b) shows a state where the frame is being folded, and (c) shows a state after folding. Each upper lateral frame 40 includes left and right side frames 43, and a central frame 44 arranged between the side frames 43. The side frames 43 are turnably supported by a connection screw 45 at both ends of the central frame 44, thereby constituting the second folding unit 42 of the upper lateral frame 40 (FIGS. 13(*b*) and (*c*) only show one of the side frames 43). Therefore, if the central frame 44 is brought up, the side frames 43 can be turned such that they substantially intersect with the central frame 44, and the upper lateral frame 40 can be folded as shown in FIG. 9.

Figure 14:
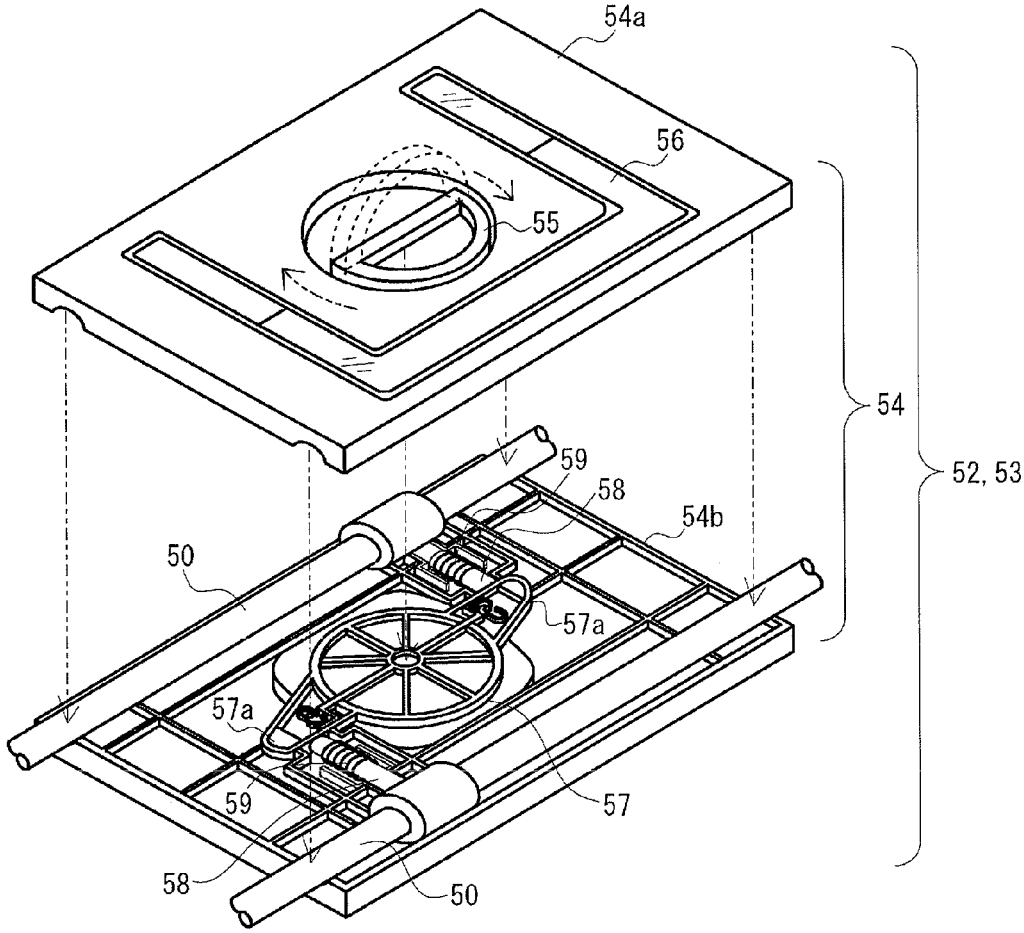
FIG. 14 is an exploded perspective view of an operating unit.
Figure 15:
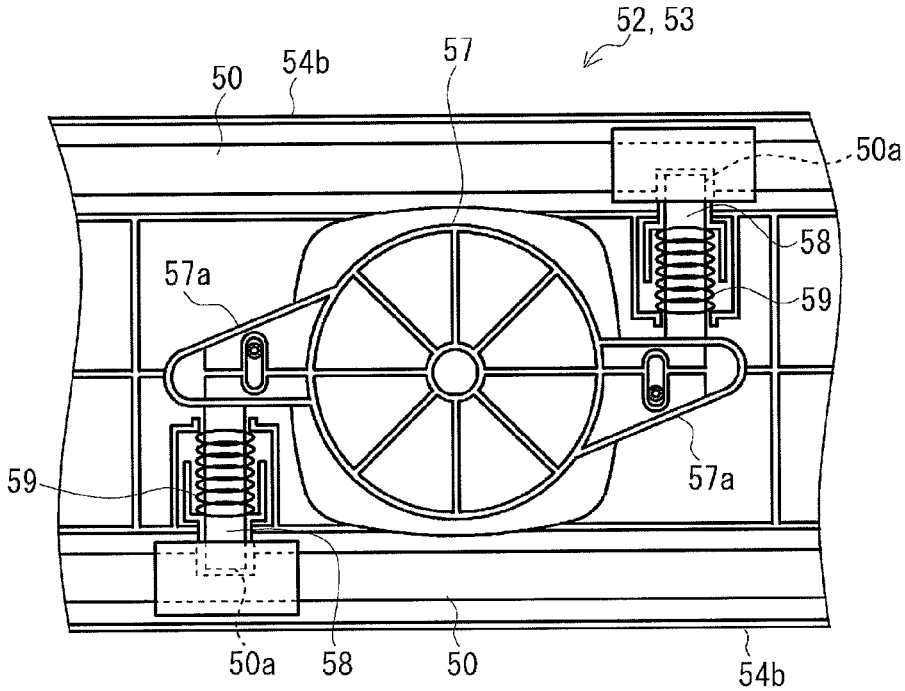
FIG. 15 is a plan view of an interior of the operating unit before an operation.
Figure 16:
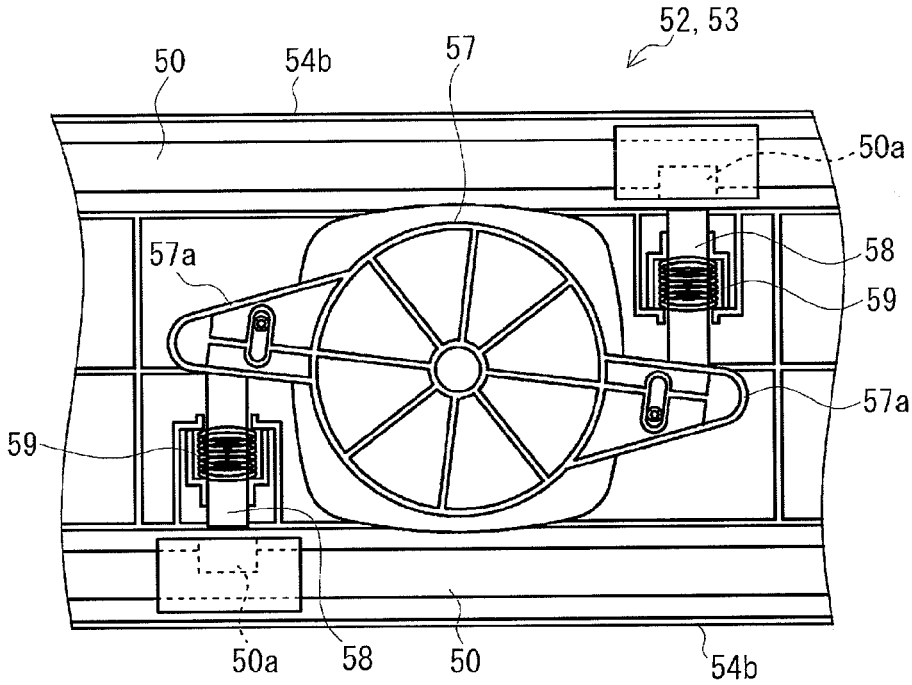
FIG. 16 is a plan view of the interior of the operating unit after an operation.

A folding structure of the lower lateral frames 50 is explained next. As shown in FIG. 6, the lower lateral frames 50 are connected to each other through an operating unit 53 that functions as the second folding unit 52. FIG. 14 is an exploded perspective view of the operating unit 53, FIG. 15 is a plan view of an interior of the operating unit 53 before an operation, and FIG. 16 is a plan view of the interior of the operating unit 53 after an operation. The operating unit 53 includes a casing 54 including an upper casing 54*a* and a lower casing 54*b*. An operating handle 55 and a moving handle 56 are accommodated in an upper surface of the upper casing 54*a* such that they can be pulled out. A rotation disc 57 and a fitting rod 58 are stored in the lower casing 54*b*.

The rotation disc 57 can rotate in a substantially horizontal plane around a flat surface center position of the rotation disc 57. The rotation disc 57 is formed with a pair of left and right projections 57*a*. The fitting rods 58 are connected to the projections 57*a*. The lower lateral frame 50 is arranged in the casing 54 such that the lower lateral frame 50 penetrates the casing 54, and a hole 50*a* is formed in the lower lateral frame 50. The hole 50*a* has a shape corresponding to the fitting rod 58 at a position corresponding to the fitting rod 58. The fitting rods 58 can be detachably inserted into the holes 50*a*.

In this state, at the initial position, the fitting rod 58 is inserted into the hole 50*a* of the lower lateral frame 50, and the lower lateral frames 50 and 51 are non-turnably fixed to the operating unit 53 through the fitting rod 58. Meanwhile, if the rotation disc 57 is rotated through the operating handle 55, the fitting rod 58 is pulled out from the lower lateral frames 50 and 51 as the rotation disc 57 rotates, and the connection between the operating unit 53 and the lower lateral frames 50 and 51 is released. If the operating unit 53 is brought up in this state, as shown in FIGS. 7 to 9, the lower lateral frame 50 turns with respect to the operating unit 53, and the lower lateral frame 50 can be folded. A spiral screw 59 that is substantially concentric with the fitting rod 58 is arranged in the lower casing 54*b*. The fitting rod 58 is biased toward the lower lateral frames 50 and 51 by the spiral screw 59, and in a state where a user releases his hand from the operating handle 55, the fitting rod 58 is maintained in the initial position.

Figure 17:
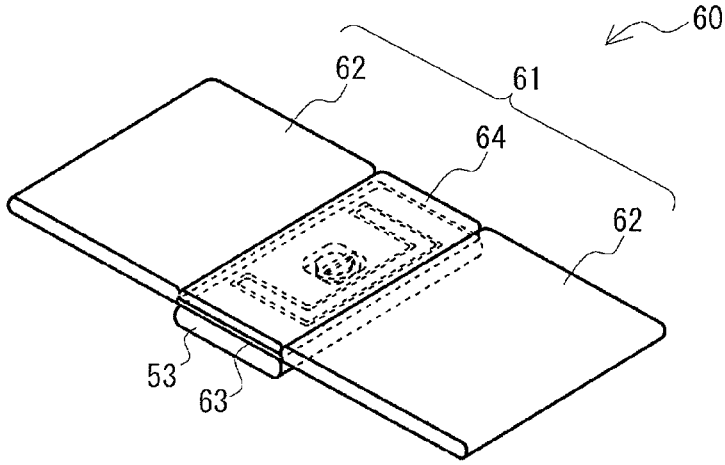
FIG. 17 is a perspective view showing the bottom plate together with the operating unit.
Figure 18:
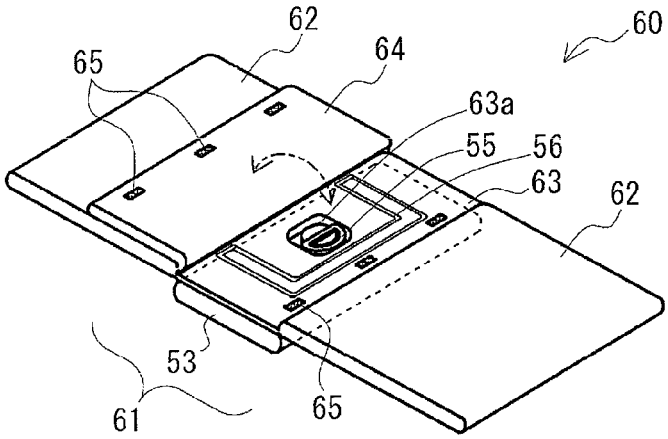
FIG. 18 is a perspective view showing a partially opened bottom plate and the operating unit.

A folding structure of the bottom plate 60 is explained next. FIG. 17 is a perspective view showing the bottom plate 60 and the operating unit 53, and FIG. 18 is a perspective view showing the partially opened bottom plate 60 and the operating unit 53. The bottom plate 60 includes a pair of side surfaces 62, a central surface 63 provided between the pair of side surfaces 62, and an open/close surface 64 provided above the central surface 63. The side surfaces 62 and the open/close surface 64 are made of a material capable of keeping comfort for an infant laid on the upper surface, such as a urethane pad. The open/close surface 64 is fixed to the side surfaces 62 at one side surface thereof by sewing, and the open/close surface 64 can open and close around the sewn line. The central surface 63 is a thin cloth body, and both surfaces of the central surface 63 are sewn onto the side surface 62. Face fasteners 65 are provided on mutually opposed surfaces of the open/close surface 64 and the central surface 63. In a state where the open/close surface 64 is closed, the open/close surface 64 and the central surface 63 are fixed to each other through the face fasteners 65 so as to prevent the open/close surface 64 from opening unintentionally.

According to such a structure, in a state where the open/close surface 64 is closed, the upper surface of the open/close surface 64 and the upper surface of the side surface 62 are substantially flush with each other, and the upper surface of the bottom plate 60 is substantially flat as a whole. Therefore, comfort of an infant laid down on the upper surface can be maintained. In a state where the open/close surface 64 is opened, the central surface 63 is exposed between the side surfaces 62. The central surface 63 and the operating unit 53 that connects the lower lateral frames 50 and 51 with each other are arranged on a mutually corresponding flat surface position, and the operating handle 55 and the moving handle 56 provided on the upper surface of the operating unit 53 can be held through an opening 63*a* formed in the central surface 63. Thus, it is possible to access the operating handle 55 and the moving handle 56 only by opening the open/close surface 64 without detaching the bottom plate 60, and it is possible to easily fold and move the furniture main body 10.

The side surface 62 and the central surface 63 are connected to each other through the sewn line, and only the side surface 62 can be folded downward around the sewn line while horizontally maintaining the central surface 63. The second folding unit 61 of the bottom plate 60 is substantially constituted by this folding structure.

The correlation between the first folding unit 31 and the second folding units 42, 52, and 61 is explained next in detail. As shown in FIG. 5, the connection stay 34 of the first folding unit 31 of the vertical frame 30 is provided substantially at the central position of the vertical frame 30 in its longitudinal direction. Therefore, in a state where the vertical frame 30 is folded, the vertical frame 30 can be folded into two at substantially equal lengths vertically around the connection stay 34, and the vertical frame 30 can be folded most compactly. Because the vertical frame 30 is folded at substantially equal lengths vertically, the vertical frame 30 can be folded while maintaining a position of the connecting unit 70 on its flat surface at the same position in any of states in FIGS. 6 to 8. The upper lateral frames 40 and 41 can be located above the lower lateral frames 50 and 51 while keeping the flat shapes of the upper lateral frames 40 and 41.

As shown in FIG. 8, the second folding unit 42 (here, the central frame 44) of the upper lateral frame 40, the second folding unit 52 (here, the operating unit 53) of the lower lateral frame 50 and the second folding unit 61 (here, the central surface 63 (not shown in FIG. 8)) of the bottom plate 60 are arranged substantially at the same position in the longitudinal direction, and they have substantially the same widths. The second folding units 42, 52, and 61 can be folded in the same folding direction (here, upward). Therefore, if the lowermost one of the second folding units 42, 52, and 61, that is, the second folding unit 52 (here, the operating unit 53 of the lower lateral frame 50) is brought in the folding direction (here, upward), all of the other second folding units 42 and 61 (here, the central frame 44 and the central surface 63) are brought up in the same folding direction in association with this motion. Thus, all of the second folding units 42, 52, and 61 can be folded collectively at the same time by a single motion, that is, by bringing up the lowermost second folding unit 52, the state shown in FIG. 8 can be easily shifted to the state shown in FIG. 9, and a folding operation can be completed. When such an effect is not required, the plane positions and widths of the second folding units 42, 52, and 61 can be different from each other. In this case, the folding operation can be completed by individually folding the second folding units 42, 52, and 61.

(Moving Structure In Folded State of Knockdown Furniture For An Infant 1)

Finally, a moving structure that makes it easier to move the knockdown furniture for an infant 1 in a folded manner is explained. As shown in FIG. 6, the vertical frames 30 and the lower lateral frames 50 are connected to the rollers 72. As shown in FIG. 3, the rollers 72 are located on one side of the lower ends of the frame 11 in the folded state of the frame 11. Thus, as shown in FIG. 4, if the entire knockdown furniture for an infant 1 is inclined and moved above the rollers 72 and the knockdown furniture for an infant 1 is pulled by hands around the rollers 72, the knockdown furniture for an infant 1 can be easily moved through the rollers 72.

As shown in FIG. 4, the bottom plate 60 includes the moving handle 56 such that the moving handle 56 can be pulled out. If the moving handle 56 is held and pulled and rotated, the knockdown furniture for an infant 1 can be pulled and rotated more easily. The moving handle 56 includes a plurality of tubes having different diameters that are superposed on each other, and the inner tube is pushed in the outer tube as necessary, and the moving handle 56 can be extended and retracted. Therefore, as shown with the phantom line in FIG. 4, the moving handle 56 can be extended when necessary, and it becomes easier to hold the moving handle 56.

(Effects of First Embodiment)

As explained above, according to the invention of the first embodiment, if the vertical frame 30 is folded, the upper lateral frames 40 and 41, the lower lateral frames 50 and 51 and the bottom plate 60 are arranged substantially in parallel to each other at positions close to each other, and by integrally folding the upper lateral frames 40 and 41, the lower lateral frames 50 and 51 and the bottom plate 60, the folding operation of the knockdown furniture for an infant 1 is completed. Because the knockdown furniture for an infant 1 can be folded without detaching the bottom plate 60, the knockdown furniture for an infant 1 can be folded remarkably easily. When the knockdown furniture for an infant 1 is to be assembled, on the other hand, because it is unnecessary to attach the bottom plate 60, the knockdown furniture for an infant 1 can be assembled remarkably easily. Further, because the vertical frames 30 are not collected to the central position, there is no danger that an infant is caught between the vertical frames 30, and safety can be enhanced. Furthermore, because the bed plate 20 and the protection cover 23 are provided, an infant can lie down more safely. Further, the knockdown furniture for an infant 1 in a folded manner can be easily moved using the rollers 72 and the moving handle 56.

[Second Embodiment]

Specific contents of a second embodiment of the present invention are explained next. According to the second embodiment, the vertical frame can be folded in a different direction from that of the first embodiment. The structures of the second embodiment are substantially the same as those of the first embodiment unless otherwise specified, and thus substantially the same structures as those of the first embodiment are designated with like names or numerals as necessary and explanations thereof will be omitted. Particularly, the structures of the bed plate and the protection cover are the same as those of the first embodiment, and thus explanations thereof will be omitted and only the structure of the frame is explained (this also applies to third and fourth embodiments).

(Outline of Folding Structure of Knockdown Furniture For An Infant)

Figure 19:
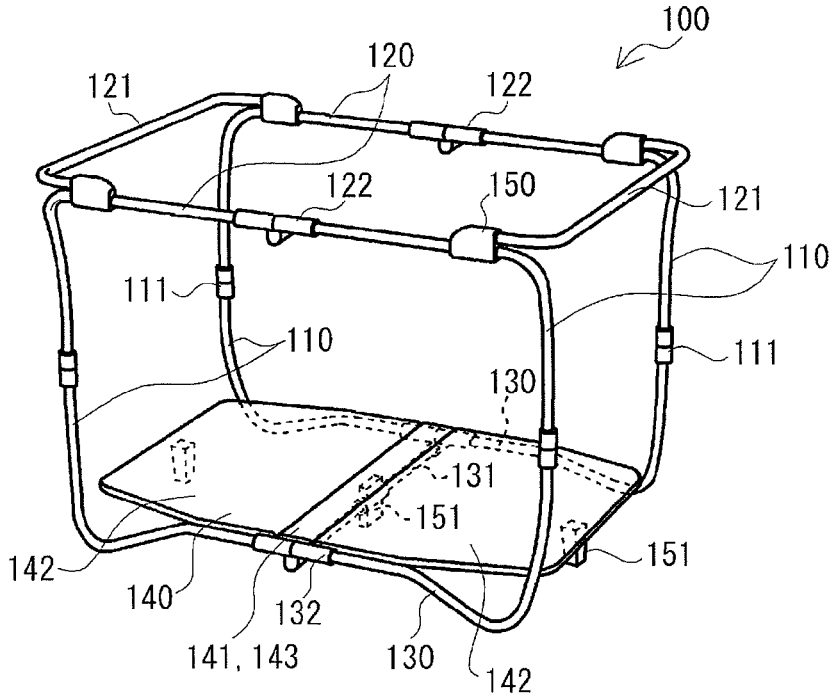
FIG. 19 is an entire perspective view of a frame of knockdown furniture for an infant according to a second embodiment.
Figure 20:
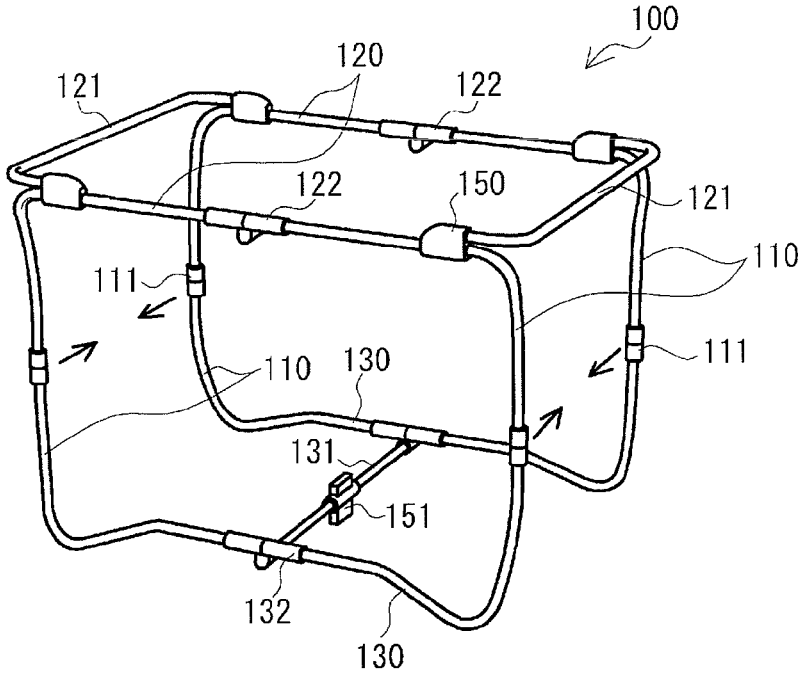
FIG. 20 is an entire perspective view of the frame from which a bottom plate is detached.
Figure 21:
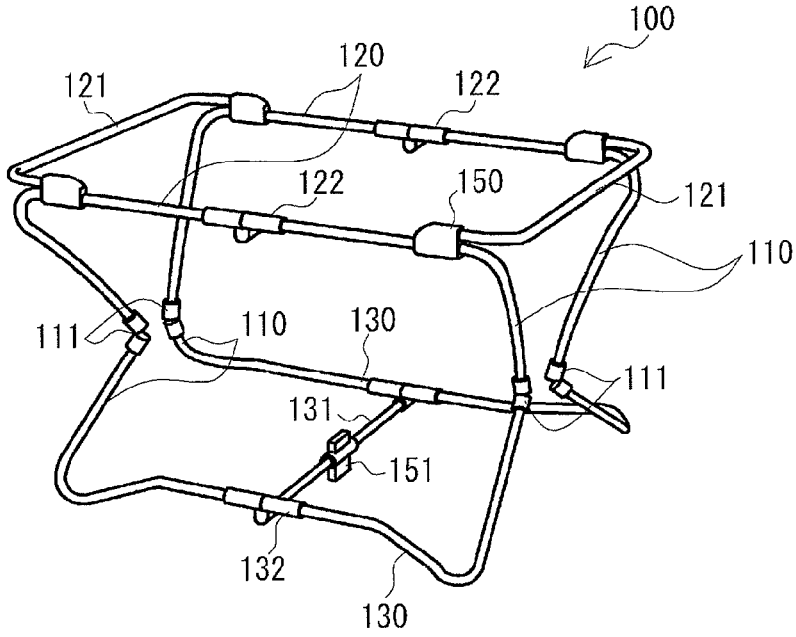
FIG. 21 is an entire perspective view of the frame that is being folded.
Figure 22:
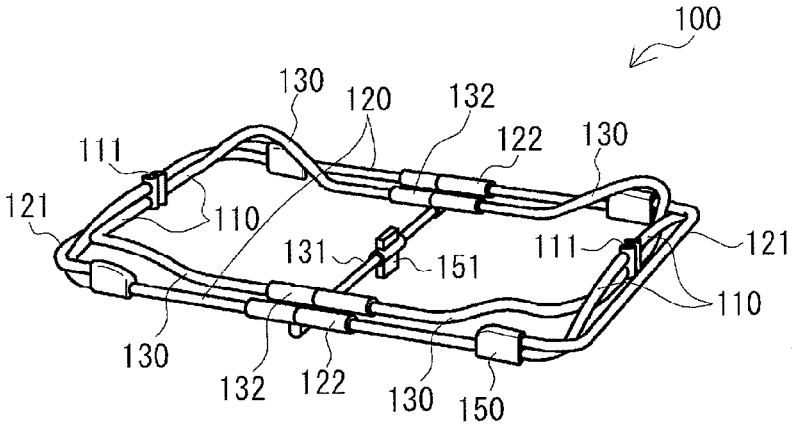
FIG. 22 is an entire perspective view of the frame that is being folded.
Figure 23:
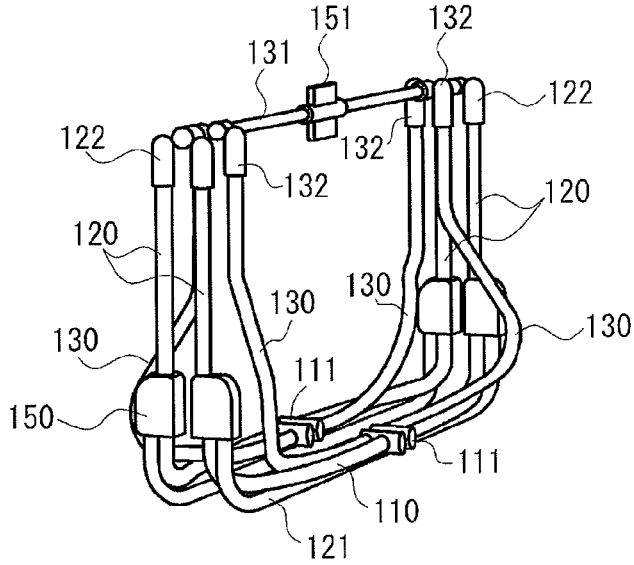
FIG. 23 is an entire perspective view of a folded frame.

First, an outline of the folding structure is explained in detail. FIG. 19 is an entire perspective view of a frame of knockdown furniture for an infant according to the second embodiment, FIG. 20 is an entire perspective view of the frame in a state where the bottom plate is detached, FIGS. 21 and 22 are entire perspective views of the frame in a state where the frame is being folded, and FIG. 23 is an entire perspective view of the folded frame. As shown in these drawings, the frame 100 according to the second embodiment includes four vertical frames 110 arranged at a distance from each other, four upper lateral frames 120 and 121 connected to upper portions of the vertical frames 110, two lower lateral frames 130 connected to lower portions of the vertical frames 110, the lower lateral frame 130 arranged between the lower lateral frames 130, and a bottom plate 140 laid above the lower lateral frames 130 and a lower central frame 131.

Each of the vertical frame 110 is provided with a first folding unit 111 at its substantially central position in the longitudinal direction. The upper lateral frame 120, the lower lateral frame 130, and the bottom plate 140 are provided with second folding units 122, 132, and 141 at substantially central positions in the longitudinal direction. The first folding unit 111 corresponds to the first folding unit in the claims, and the second folding units 122, 132, and 141 correspond to the second folding unit in the claims. The vertical frame 110, the upper lateral frame 120, the lower lateral frame 130, and the bottom plate 140 can be folded into two at the central positions in the longitudinal direction using the first folding unit 111 and the second folding units 122, 132, and 141.

The vertical frames 110 and the upper lateral frames 120 and 121 are connected to each other through connecting units 150. Each of the connecting unit incorporates a known turning mechanism (not shown) therein, and the vertical frame 110 can turn with respect to the connecting unit 150. The vertical frame 110 and the lower lateral frame 130 are made of a single continuous tube material, and these frames are integrally turned at the time of a folding operation. The bottom plate 140 includes a pair of side surfaces 142, and a central surface 143 provided between the pair of side surfaces 142. A lower portion of the side surface 142 of the bottom plate 140 and the lower central frame 131 are provided with legs 151. By bringing the legs 151 into abutment against a floor surface, the frame 100 can be held stably.

In such a structure, by pressing each of the vertical frame 110 in predetermined folding directions (the directions indicated by the arrows in FIG. 20, and a central direction on the narrow side surface of the parallelepiped formed of the frame 100), the vertical frame 110 can be folded into two at the first folding unit 111, and the state shown in FIG. 21 can be established. In this state, an upper portion of each of the vertical frame 110 turns with respect to the connecting unit 150, a lower portion of each of the vertical frame 110 turns integrally with the lower lateral frame 130, the upper lateral frame 120 moves downward while keeping its flat shape, it approaches the lower lateral frame 130 and finally, the state shown in FIG. 22 is established. In this state, the upper lateral frame 120 and the lower lateral frame 130 are superposed on each other, and the frame 100 becomes a single substantially flat plate body as a whole. Thereafter, the upper lateral frame 120, the lower lateral frame 130, and the bottom plate 140 are folded into two at the second folding units 122, 132, and 141 by bringing up the lower lateral frame 130, and the state shown in FIG. 23 is established. FIG. 19 shows a state where the frame cover 12 is detached, and FIGS. 20 to 23 show a state where the frame cover 12 and the bottom plate 140 are detached. However, the illustrations are for the sake of convenience, and in practice, the frame 100 can be folded in a state where the frame cover 12 and the bottom plate 140 are remained attached.

Parts and correlations of the structures of the various portions that make it possible to fold the frame are explained next in detail. The second folding unit 122 of the upper lateral frame 120, the second folding unit 132 of the lower lateral frame 130 and the second folding unit 141 of the bottom plate 140 are arranged substantially at the same positions in the longitudinal direction, and have substantially the same widths. Therefore, if the lowermost one of the second folding units 122, 132, and 141 (here, the second folding unit 132 of the lower lateral frame 130) is brought up and folded, other second folding units (here, the second folding unit 122 of the upper lateral frame 120 and the second folding unit 141 of the bottom plate 140) are also folded substantially at the same positions on the plane and with the same widths. Therefore, by carrying out a single motion, that is, by bringing up the one second folding unit, the state shown in FIG. 22 can be easily shifted to the state shown in FIG. 23, and the folding operation is completed.

Particularly, the second embodiment is constituted such that the second folding units 122, 132, and 141 fold the upper lateral frame 120, the lower lateral frame 130, and the bottom plate 140 into two, and a horizontal width W in the folded state is substantially eliminated. Therefore, in the folded state, the frame can be folded more compactly as compared with the first embodiment.

(Effects of Second Embodiment)

As explained above, according to the invention of the second embodiment, the knockdown furniture for an infant can be folded with a different structure from that of the first embodiment, and the same effects as those of the first embodiment can be achieved. Because the folding width is eliminated, the knockdown furniture can be folded more compactly.

[Third Embodiment]

Specific contents of a third embodiment of the present invention are explained next. While the third embodiment has a folding structure similar to that of the second embodiment, the third embodiment includes a folding width. The structures of the third embodiment are substantially the same as those of the second embodiment unless otherwise specified, and thus substantially the same structures as those of the second embodiment are designated with like names or numerals as necessary and explanations thereof will be omitted.

(Outline of Folding Structure of Knockdown Furniture For An Infant)

Figure 24:
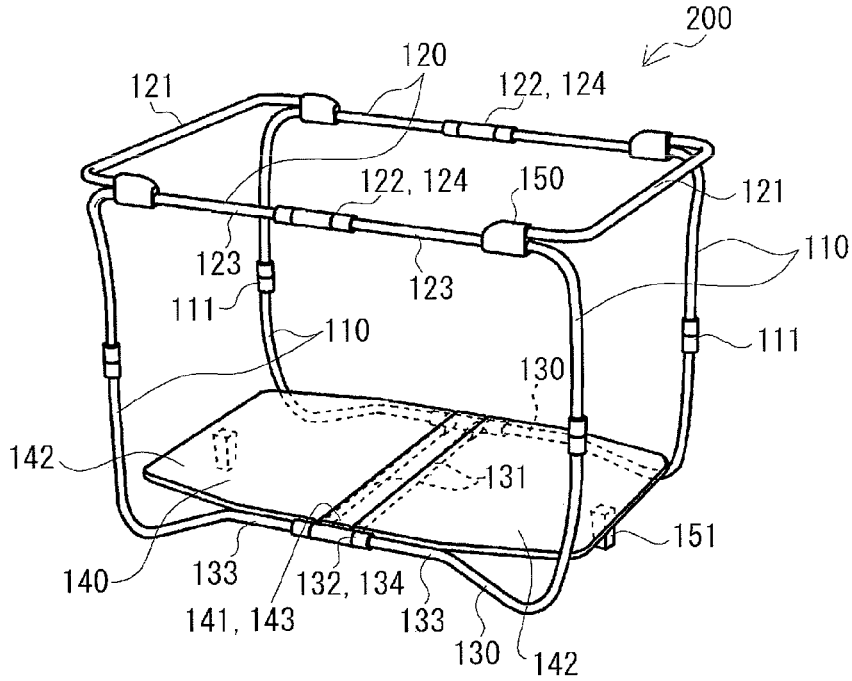
FIG. 24 is an entire perspective view of a frame of knockdown furniture for an infant according to a third embodiment.
Figure 25:
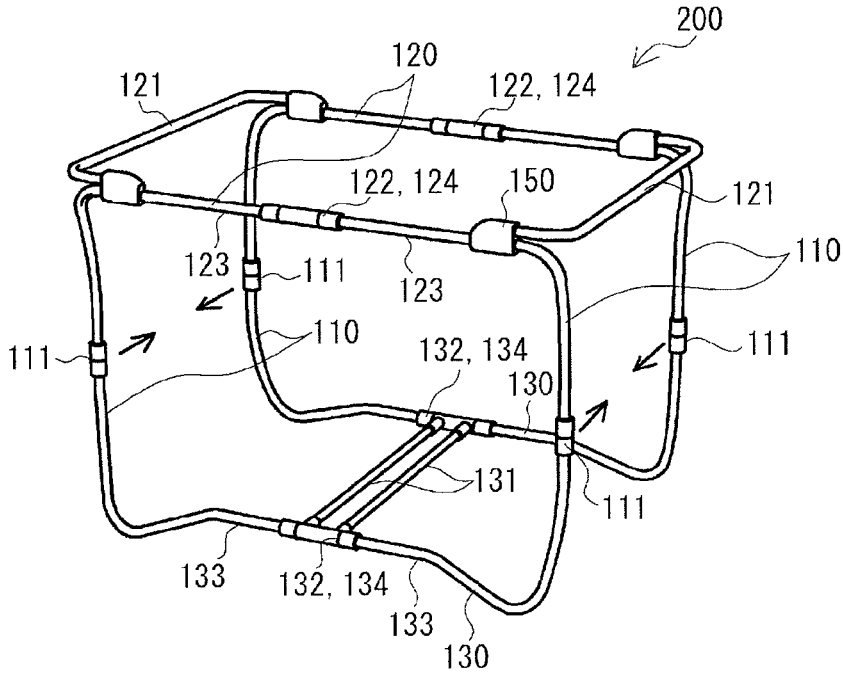
FIG. 25 is an entire perspective view of the frame from which a bottom plate is detached.
Figure 26:
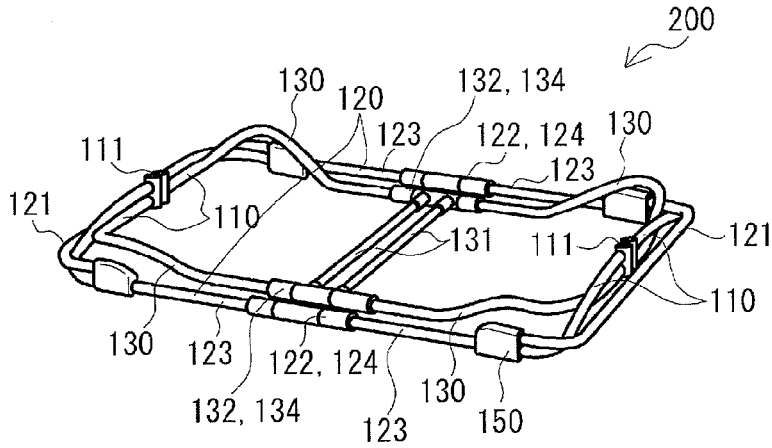
FIG. 26 is an entire perspective view of the frame that is being folded.
Figure 27:
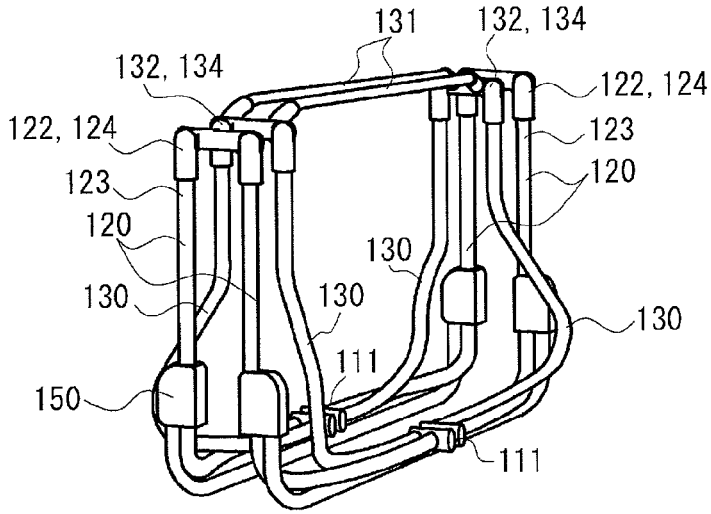
FIG. 27 is an entire perspective view of the folded frame.

First, an outline of a folding structure of a furniture main body is explained in detail. FIG. 24 is an entire perspective view of a frame of knockdown furniture for an infant according to the third embodiment, FIG. 25 is an entire perspective view of the frame in a state where the bottom plate is detached, FIG. 26 is an entire perspective view of the frame in a state where the frame is being folded, and FIG. 27 is an entire perspective view of the folded frame. As shown in these drawings, the frame 200 according to the third embodiment has basically the same structure as that of the second embodiment, and the second folding unit 122 of the upper lateral frame 120 includes a pair of side frames 123 and a central frame 124 arranged between the side frames 123 like the second folding unit 42 according to the first embodiment. Similarly, the second folding unit 132 of the lower lateral frame 130 includes a pair of side frames 133 and a central frame 134 arranged between the side frames 133. The knockdown furniture includes a plurality of the lower central frames 131.

In such a structure, the frame 200 according to the third embodiment can be basically folded like the second embodiment. That is, by pressing each of the vertical frame 110 in the directions indicated by the arrows in FIG. 25, each of the vertical frame 110 is folded at the first folding unit 111 and finally, the state shown in FIG. 26 is established. In this state, the upper lateral frame 120 and the lower lateral frame 130 are superposed on each other, and the frame 200 becomes a single substantially flat plate body as a whole. Thereafter, the upper lateral frame 120, the lower lateral frame 130, and the bottom plate 140 are folded into two at the second folding units 122, 132, and 141 by bringing up the lower lateral frame 130, and the state shown in FIG. 27 is established. FIG. 24 shows a state where the frame cover 12 is detached, and FIGS. 25 to 27 show a state where the frame cover 12 and the bottom plate 140 are detached. However, the illustrations are for the sake of convenience, and in practice, the frame 200 can be folded in a state where the frame cover 12 and the bottom plate 140 are remained attached.

In the second embodiment, the second folding unit 122 of the upper lateral frame 120 is provided with the central frame 124, and the second folding unit 132 of the lower lateral frame 130 is provided with the central frame 134. Therefore, even in a state after folding, the central frame 124 and the central frame 134 are maintained horizontally, and a predetermined folding width is maintained like the first embodiment. Therefore, a wide and stable folded state can be constituted.

(Effects of Third Embodiment)

As explained above, according to the invention of the third embodiment, because a predetermined folding width is formed, the folding width is maintained and the wide and stable folded state can be constituted, in addition to the same basic effect as that of the second embodiment.

[Fourth Embodiment]

Specific contents of a fourth embodiment of the present invention are explained next. In the fourth embodiment, the vertical frame can be folded in a direction different from that of the first embodiment. The structures of the fourth embodiment are substantially the same as those of the first embodiment unless otherwise specified, and thus substantially the same structures as those of the first embodiment are designated with like names or numerals as necessary and explanations thereof will be omitted.

(Outline of Folding Structure of Knockdown Furniture For An Infant)

Figure 28:
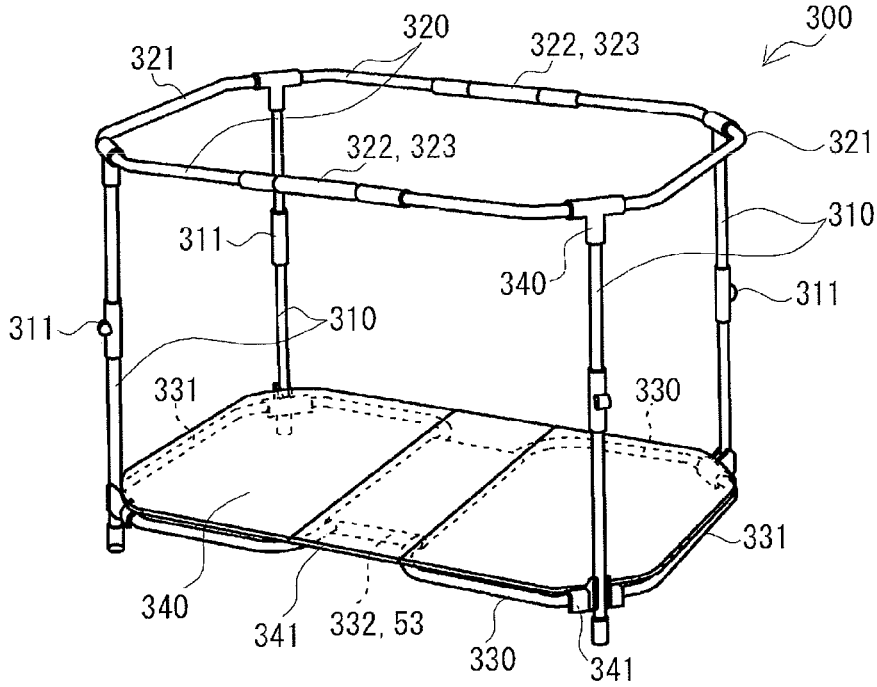
FIG. 28 is an entire perspective view of a frame of knockdown furniture for an infant according to a fourth embodiment.
Figure 29:
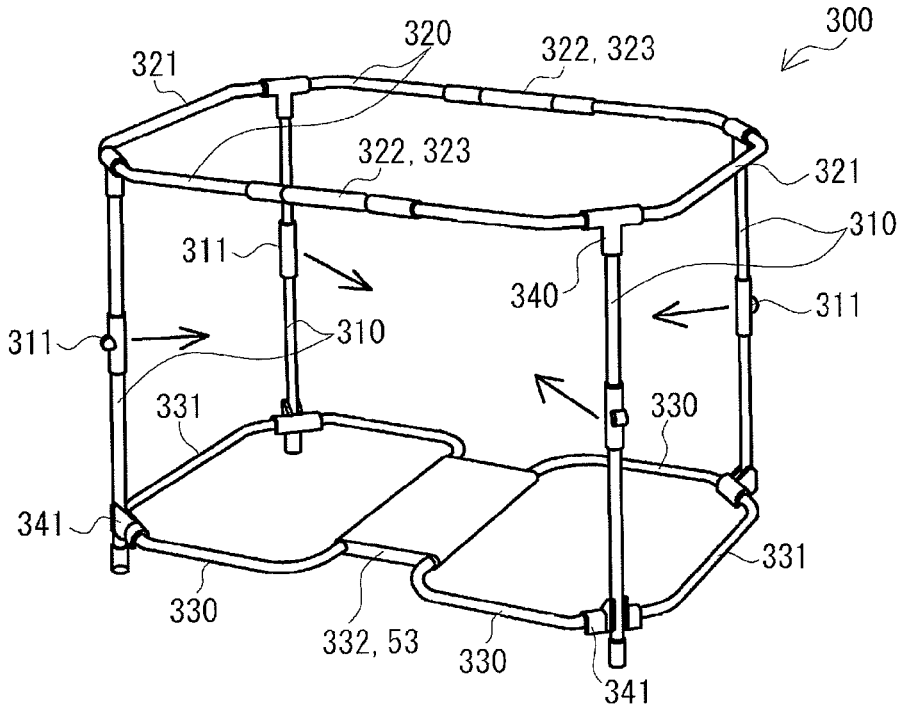
FIG. 29 is an entire perspective view of the frame from which a bottom plate is detached.
Figure 30:
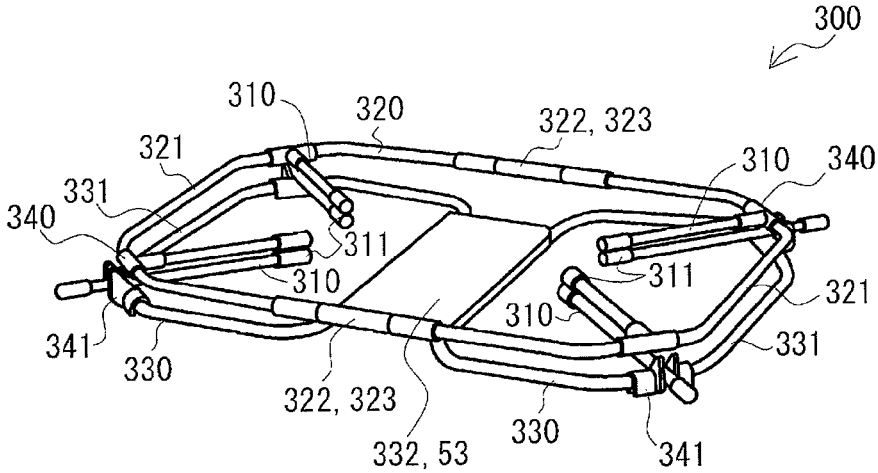
FIG. 30 is an entire perspective view of the frame that is being folded.
Figure 31:
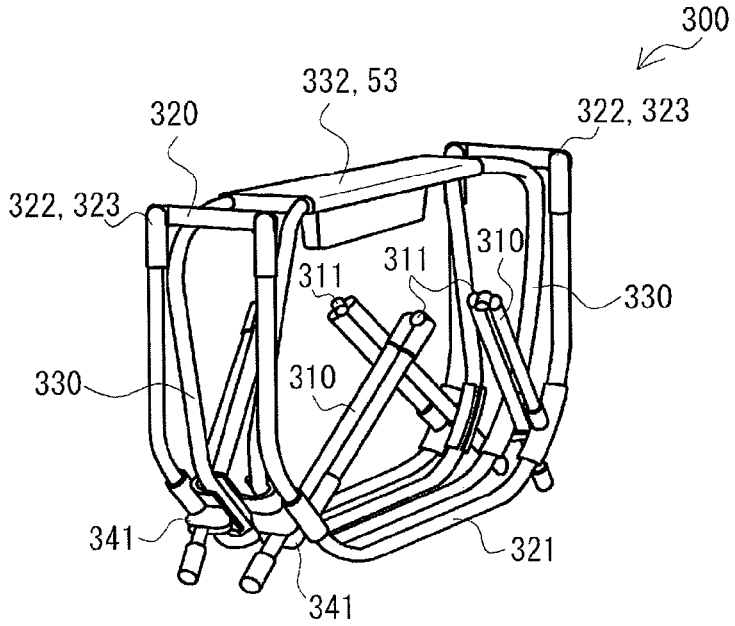
FIG. 31 is an entire perspective view of the folded frame.

First, an outline of a folding structure of a furniture main body is explained in detail. FIG. 28 is an entire perspective view of a frame of knockdown furniture for an infant according to the fourth embodiment, FIG. 29 is an entire perspective view of the frame in a state where the bottom plate is detached, FIG. 30 is an entire perspective view of the frame in a state where the frame is being folded, and FIG. 31 is an entire perspective view of the folded frame. As shown in these drawings, the frame 300 according to the fourth embodiment includes four vertical frames 310 arranged at a distance from each other, four upper lateral frames 320 and 321 connected to upper portions of the vertical frames 310, four lower lateral frames 330 and 331 connected to lower portions of the vertical frames 310, and a bottom plate 340 laid above the lower lateral frames 330 and 331.

Among these elements, the vertical frame 310 has substantially the same structure as that of the vertical frame 110 according to the second embodiment. However, there is a difference in the vertical frame 310 that a first folding unit 311 is folded in different direction. The upper lateral frames 320 and 321, the lower lateral frames 330 and 331 and the bottom plate 340 have the same structures as those of the upper lateral frames 40 and 41, the lower lateral frames 50 and 51 and the bottom plate 60 according to the first embodiment, and include second folding units 322, 332, and 341 (the operating handle 55 and the moving handle 56 of the second folding unit 332 are omitted in the fourth embodiment). The first folding unit 311 corresponds to the first folding unit in the claims, and the second folding units 322, 332, and 341 correspond to the second folding unit in the claims. Furthermore, each of the vertical frame 310 is turnably connected to the upper lateral frame 320 through a connecting unit 340 having a substantially T-shaped side surface. Further, each of the vertical frame 310 is turnably connected to the lower lateral frame 330 through a connecting unit 341.

In such a structure, by pressing each of the vertical frame 310 in predetermined folding directions (the directions indicated by the arrows in FIG. 29, and a central direction on the parallelepiped formed of the frame 300), the vertical frame 310 can be folded into two at the first folding unit 311. In this state, each of the vertical frame 310 turns with respect to the upper lateral frame 320 and the lower lateral frame 330, moves downward while keeping the flat shape of the upper lateral frame 320, the vertical frame 310 approaches the lower lateral frame 330 and finally, the state shown in FIG. 30 is established. In this state, the upper lateral frame 320 and the lower lateral frame 330 are superposed on each other, and the frame 300 becomes a single substantially flat plate body as a whole. Thereafter, by bringing up the second folding unit 332 of the lower lateral frame 330, the upper lateral frame 320 and the lower lateral frame 330 are folded at the second folding units 322 and 332, and the state shown in FIG. 31 is established. FIG. 28 shows a state where the frame cover 12 is detached, and FIGS. 29 to 31 show a state where the frame cover 12 and the bottom plate 60 are detached. However, the illustrations are for the sake of convenience, and in practice, the frame 300 can be folded in a state where the frame cover 12 and the bottom plate 60 are remained attached.

In this fourth embodiment, because the second folding unit 322 of the upper lateral frame 320 is provided with a central frame 323 and the second folding unit 332 of the lower lateral frame 330 is provided with the operating unit 53, even after the knockdown furniture is folded, the central frame 323 and the operating unit 53 are maintained horizontally, and a predetermined folding width is maintained like the first and third embodiments. Therefore, a wide and stable folded state can be constituted.

(Effects of Fourth Embodiment)

As explained above, according to the invention of the fourth embodiment, the knockdown furniture for an infant can be folded with a different structure from that of the first embodiment, and the same effects as those of the first embodiment can be achieved. By forming the predetermined folding width, the wide and stable folded state maintaining this folding width can be constituted.

[Fifth Embodiment]

Specific contents of a fifth embodiment of the present invention are explained next. In the fifth embodiment, a bed plate on which an infant is laid down can be folded in a flat shape along the bottom plate. The structures of the fifth embodiment are substantially the same as those of the first embodiment unless otherwise specified, and thus substantially the same structures as those of the first embodiment are designated with like names or numerals as necessary and explanations thereof will be omitted.

Figure 32:
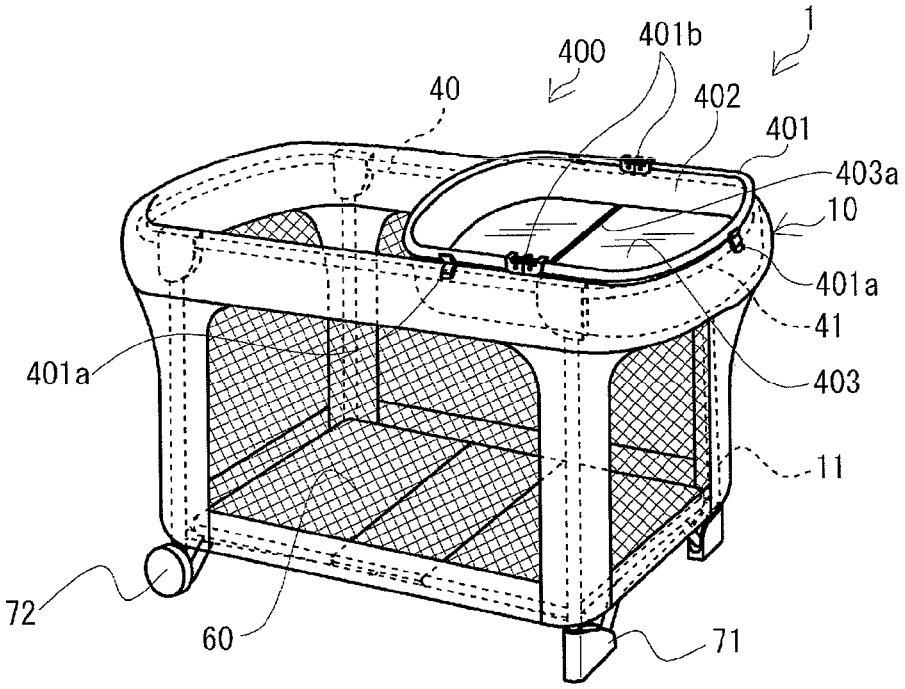
FIG. 32 is an entire perspective view of a frame of knockdown furniture for an infant according to a fifth embodiment.
Figure 33:
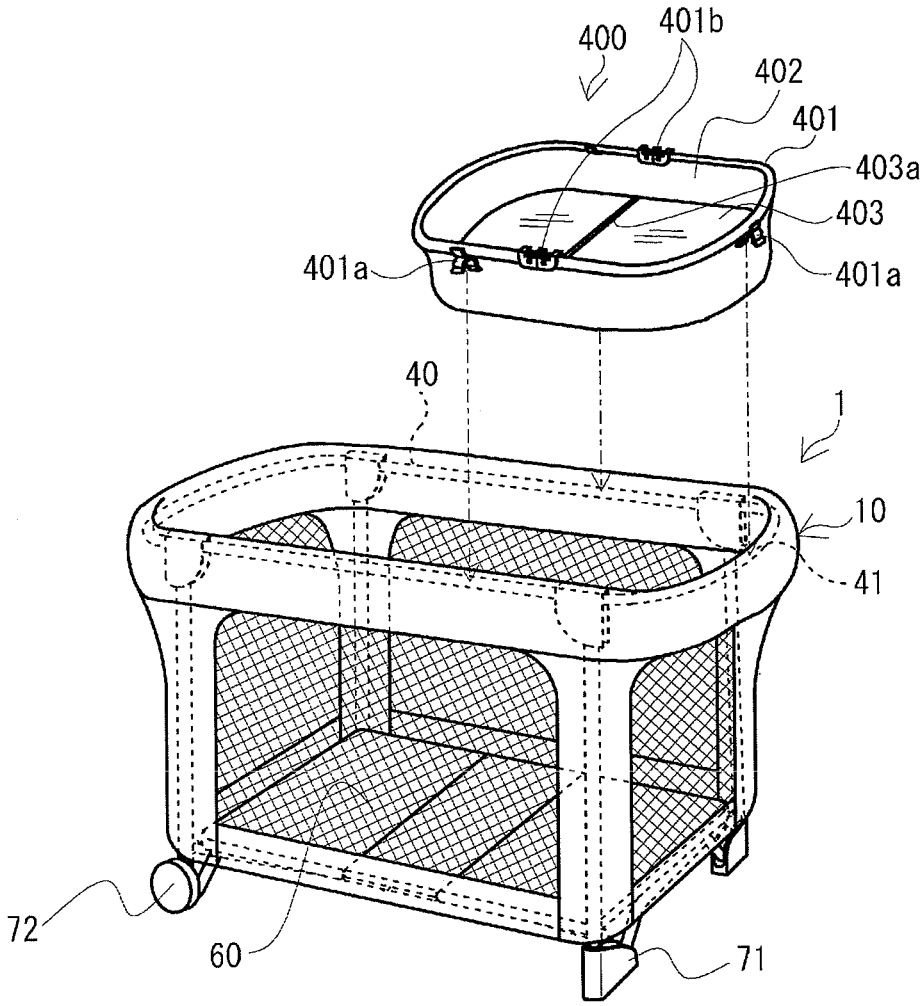
FIG. 33 is an exploded perspective view of FIG. 32.

FIG. 32 is an entire perspective view of a frame of knockdown furniture for an infant according to the fifth embodiment, and FIG. 33 is an exploded perspective view of FIG. 32. As shown in these drawings, a diaper changing sheet (a bed plate) 400 according to the fifth embodiment is for laying an infant on its upper surface to change a diaper, and the diaper changing sheet 400 is detachably attached to the furniture main body 10.

Figure 34:
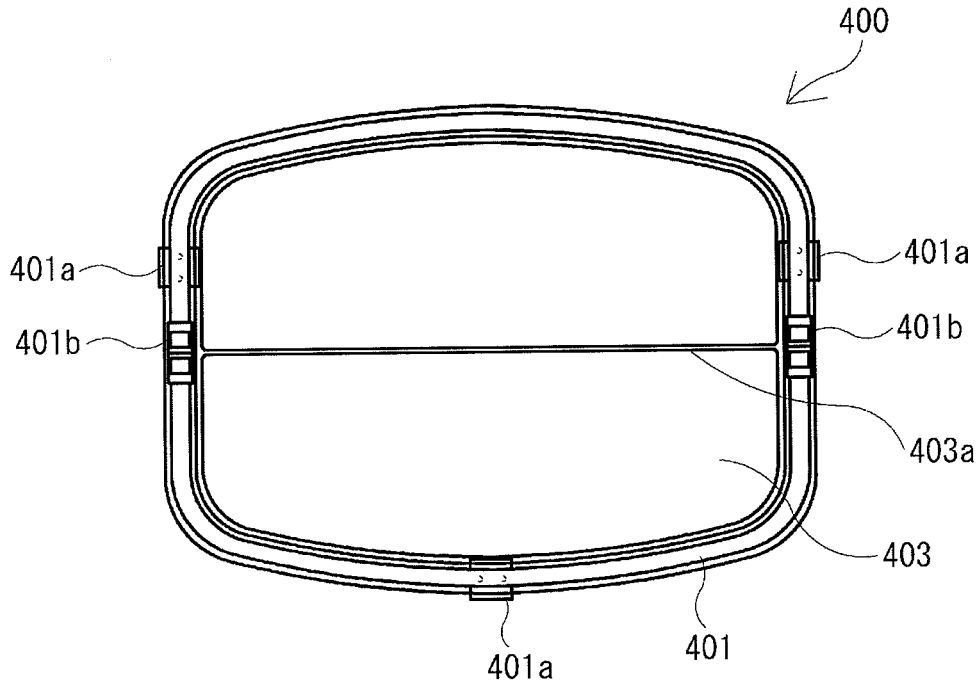
FIG. 34 is a plan view of a diaper changing sheet.
Figure 35:
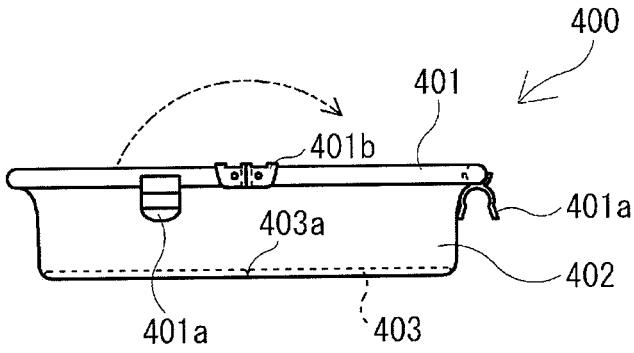
FIG. 35 is a side view of the diaper changing sheet.

FIG. 34 is a plan view of the diaper changing sheet 400, and FIG. 35 is a side view of the diaper changing sheet 400. The diaper changing sheet 400 includes a frame 401, a side sheet 402, and a bottom plate 403.

The frame 401 is a basic structure of the diaper changing sheet 400, and is formed into a substantially flat rectangular and annular shape using hard resin or metal. Reversed U-shaped hooks 401*a* are fixed to three locations of an outer surface of the frame 401. The hooks 401*a* are detachably engaged with the frame 11 (Specifically, the upper lateral frames 40 and 41) of the furniture main body 10, and the diaper changing sheet 400 can be attached to the furniture main body 10 as shown in FIG. 32. Hinges 401*b* are provided substantially at central positions of a pair of long sides of the frame 401, and the frame 401 can be folded through the hinges 401*b*. The hinge 401*b* is provided with a lock mechanism for preventing the hinge 401*b* from being folded unintentionally. Because a known lock mechanism of the hinge 401*b* used for folding furniture can be used as the lock mechanism, detailed explanations and illustrations thereof will be omitted.

The side sheet 402 is a cloth stretched between the frame 401 and the bottom plate 403. The side sheet 402 extends from entire periphery of a lower edge of the frame 401 and reaches the entire periphery of an upper line of the bottom plate 403. By connecting the frame 401 and the bottom plate 403 through the side sheet 402, the diaper changing sheet 400 can be easily folded.

The bottom plate 403 forms a placing surface on which an infant is laid down, and is formed into the same rectangular shape as that of the frame 401 using hard resin or metal plate. The bottom plate 403 can be folded into two around a division line 403*a* connecting substantially central positions of the long sides thereof (planarly, a position corresponding to the hinge 401*b* of the frame 401).

Figure 36:
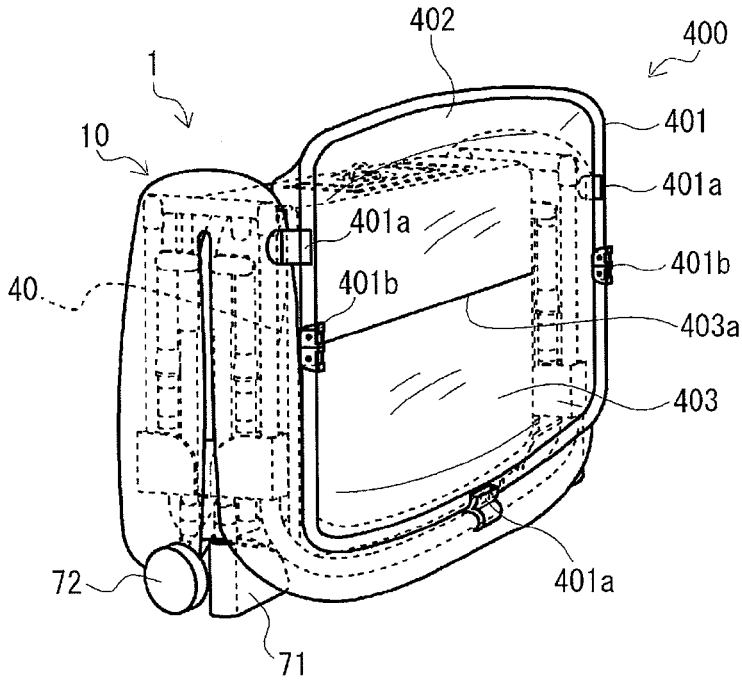
FIG. 36 is a perspective view showing a state after a furniture main body is folded.

Because the diaper changing sheet 400 can be detachable from the furniture main body 10, the furniture main body 10 can be folded in the same manner as the first embodiment in a state where the diaper changing sheet 400 is detached from the furniture main body 10, however, the furniture main body 10 can be also folded without detaching the diaper changing sheet 400 from the furniture main body 10. That is, as shown in FIG. 32, attaching positions of the hooks 401*a* of the diaper changing sheet 400 to the furniture main body 10 are any one of sides (the right side in FIG. 32) when the furniture main body 10 is divided into two at a substantially central position (a position of the second folding unit) in its longitudinal direction. Therefore, also when the furniture main body 10 is folded through the second folding unit in the same manner as that of the first embodiment, the hooks 401*a* do not hinder a folding operation at the second folding unit, and the furniture main body 10 can be folded. A state after the folding operation is shown in FIG. 36.

Figure 37:
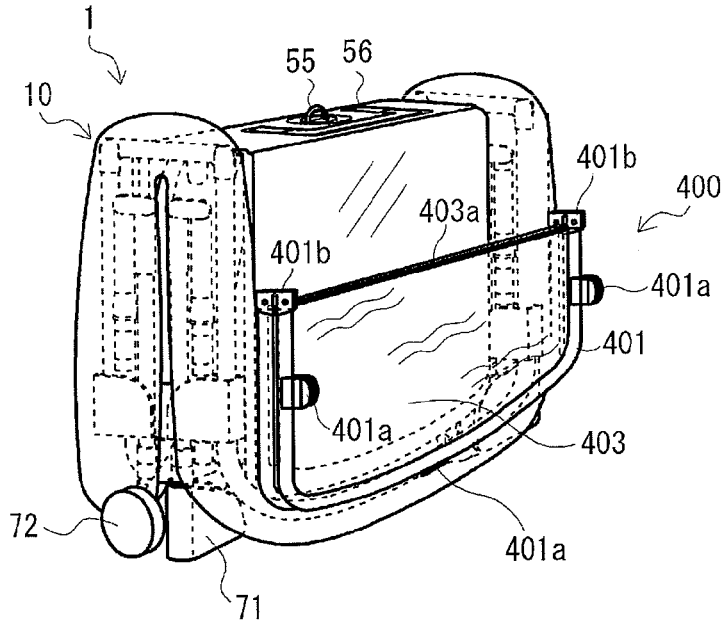
FIG. 37 is a perspective view showing a state after the furniture main body is folded, continuous from FIG. 36.

The entire length of the diaper changing sheet 400 in its longitudinal direction is slightly longer than a half of the furniture main body 10 in its longitudinal direction. Therefore, in the state shown in FIG. 36, an upper end of the diaper changing sheet 400 projects upward from the upper end of the furniture main body 10, and there is a possibility that the portability and storability of the furniture main body 10 are deteriorated. To prevent this, in the fifth embodiment, the diaper changing sheet 400 is folded into two to achieve a state shown in FIG. 37. Specifically, in the state shown in FIG. 36, the lock mechanism of the hinge 401*b* is unlocked by a known method, an upper end of the diaper changing sheet 400 is pulled rightward and frontward in the drawing. With this configuration, two of the three hooks 401*a* engaged with the upper lateral frame 40 are disengaged, the bottom plate 403 is folded into two around the division line 403*a*, the side sheet 402 is deformed to follow this motion and finally, the state shown in FIG. 37 is established. In this state, because the upper end of the diaper changing sheet 400 is located lower than the upper end of the furniture main body 10, the storing height of the knockdown furniture for an infant 1 can be lowered as a whole, and thus the portability and storability can be enhanced. Particularly, because the diaper changing sheet 400 and the furniture main body 10 can be folded without detaching the diaper changing sheet 400 from the furniture main body 10, the folding operation can be performed easily and smoothly. When the entire length of the diaper changing sheet 400 in its longitudinal direction is set half or less of the furniture main body 10 in its longitudinal direction, because the upper portion of the diaper changing sheet 400 does not project upward from the upper end of the furniture main body 10 also in the state shown in FIG. 36, the folding function of the diaper changing sheet 400 can be omitted.

(Effects of Fifth Embodiment)

As explained above, according to the invention of the fifth embodiment, the furniture main body 10 can be folded in a state where the diaper changing sheet 400 is attached, and the folding operation can be performed easily and smoothly. The storing height of the knockdown furniture for an infant 1 as a whole can be reduced, and the portability and storability can be enhanced.

[Sixth Embodiment]

Specific contents of a sixth embodiment of the present invention are explained next. In the sixth embodiment, the moving handle is accommodated in the frame body such that the moving handle can be taken out from the frame body. The structures of the sixth embodiment are substantially the same as those of the first embodiment unless otherwise specified, and thus substantially the same structures as those of the first embodiment are designated with like names or numerals as necessary and explanations thereof will be omitted.

Figure 38:
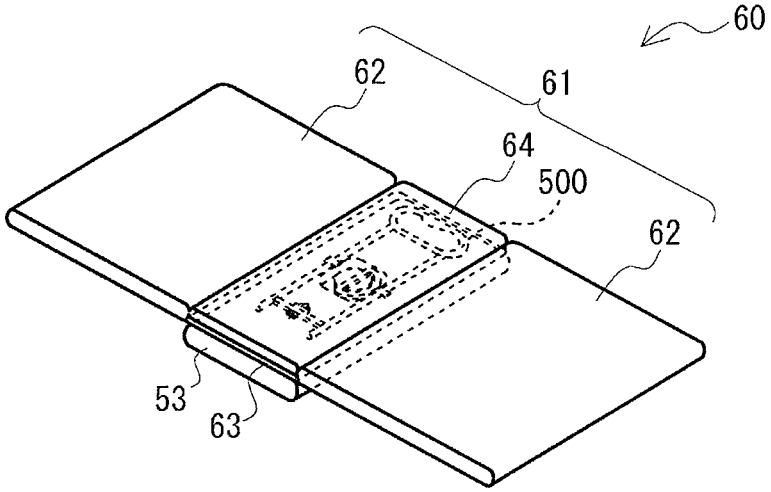
FIG. 38 is a perspective view showing a bottom plate of a sixth embodiment together with an operating unit.
Figure 39:
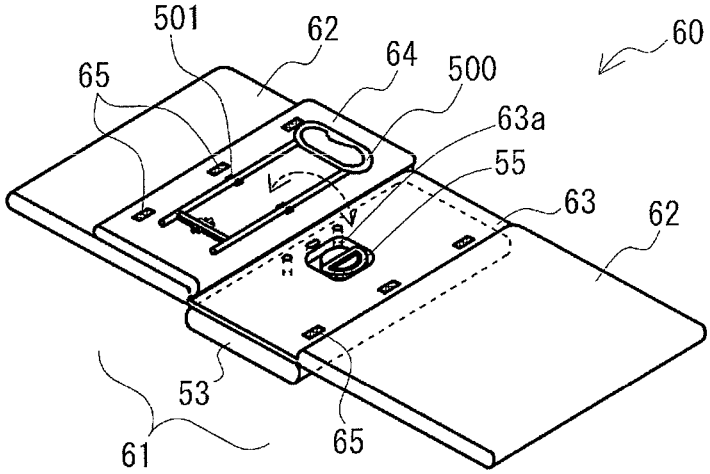
FIG. 39 is a perspective view showing a partially opened bottom plate and the operating unit.

FIG. 38 is a perspective view showing a bottom plate according to the sixth embodiment together with the operating unit, and FIG. 39 is a perspective view showing the partially opened bottom plate and the operating unit. As shown in these drawings, in the sixth embodiment, a moving handle 500 is provided instead of the moving handle 56 according to the first embodiment. As shown in FIG. 39, the moving handle 500 is detachably attached to a back surface of the open/close surface 64 (a surface opposed to the central surface 63) through an attaching hook 501.

Figure 40:
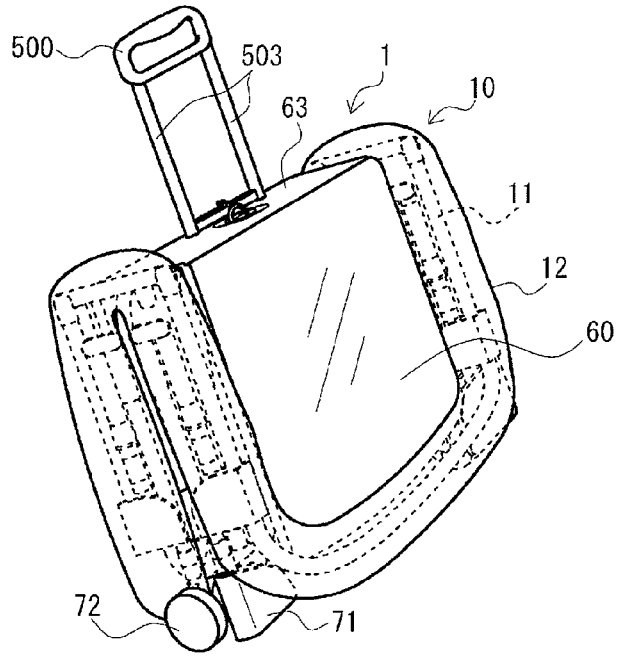
FIG. 40 is an entire perspective view showing a moving state of the furniture main body.

The moving handle 500 is detached from the open/close surface 64, and the moving handle 500 is detachably attached to the central surface 63 and the operating unit 53. With this configuration, if the moving handle 500 is held and pulled and rotated as shown in FIG. 40, the knockdown furniture for an infant 1 can be pulled and rotated more easily.

Figure 41:
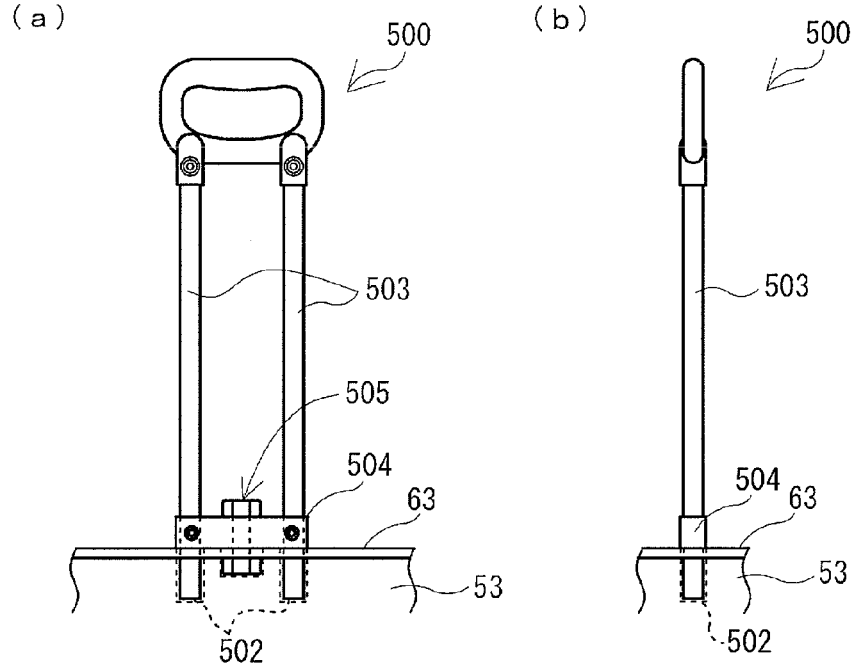
FIG. 41 are enlarged views of a moving handle and its periphery, where (a) is a front view and (b) is a side view.
Figure 42:
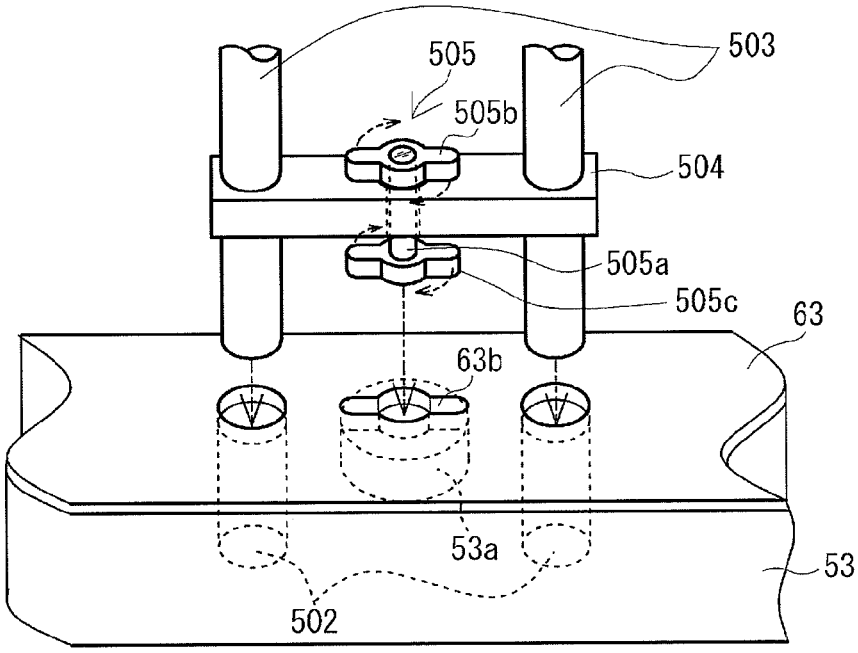
FIG. 42 is an enlarged perspective view of a periphery of an attaching and detaching mechanism of the moving handle.

The attaching and detaching structure of the moving handle 500 is explained next. FIG. 41 are enlarged views of the moving handle 500 and its periphery, where (a) is a front view and (b) is a side view. FIG. 42 is an enlarged perspective view of a periphery of an attaching and detaching mechanism of the moving handle 500. As shown in these drawings, the central surface 63 and the operating unit 53 are provided with attaching holes 502, and two rods 503 of the moving handle 500 can be inserted into the attaching holes 502.

The moving handle 500 is provided with a connecting rod 504 that connects the two rods 503 with each other. The connecting rod 504 is provided with an attaching and detaching mechanism 505. As shown in FIG. 42, the attaching and detaching mechanism 505 includes an operation knob 505*b* and an engaging unit 505*c* provided on an end of a rotation shaft 505*a* that is rotatably inserted into the connecting rod 504. The central surface 63 is provided with a through hole 63*b* having the same shape as that of the engaging unit 505*c*. The through hole 63*b* is formed at a position corresponding to the engaging unit 505*c*. Further, the operating unit 53 is formed with a substantially cylindrical space 53*a* that is in communication with the through hole 63*b*, and the engaging unit 505*c* can be stored in the space 53*a*.

In such a structure, if the two rods 503 of the moving handle 500 are inserted through the attaching holes 502, the engaging unit 505*c* is inserted into the space 53*a* through the through hole 63*b*. In this state, if the operation knob 505*b* is rotated in a predetermined direction (the direction indicated by the arrow in FIG. 42), the engaging unit 505*c* rotates in the space 53*a*, the engaging unit 505*c* moves to a position that does not correspond to the through hole 63*b*, and the engaging unit 505*c* cannot be inserted into the through hole 63*b*. Therefore, the moving handle 500 can be easily attached to the central surface 63 and the operating unit 53. Further, by performing an operation by reversing the attaching operation, the moving handle 500 can be easily detached from the central surface 63 and the operating unit 53. Therefore, only when necessary, the moving handle 500 can be attached to the knockdown furniture for an infant 1, the knockdown furniture for an infant 1 can be pulled and rotated, and when unnecessary, the moving handle 500 is attached to the open/close surface 64, and the knockdown furniture for an infant 1 can be stored in an unexposed manner.

(Effects of Sixth Embodiment)

As explained above, according to the sixth embodiment, because the moving handle 500 is attached to the knockdown furniture for an infant 1 and the knockdown furniture for an infant 1 can be pulled and rotated only when necessary, it is possible to prevent the moving handle 500 from hindering a storing operation.

[III] Modifications To Embodiments

While embodiments of the present invention have been explained above, specific configurations and means of the present invention can be arbitrarily modified or improved within the technical scope of each invention described in the claims.

(Configuration, Manufacturing Method, Or Usage Method)

Each configuration and usage method shown in the above specification and the drawings are only exemplary, and they can be arbitrarily changed unless otherwise specified.

(Correlations Between Embodiments)

The structures shown in each of the embodiments are mutually applicable to other embodiments. For example, the connecting unit and the rollers according to the first embodiment can be applied to the second to sixth embodiments.

Industrial Applicability

The present invention can be applied to knockdown furniture for an infant that forms a playing space or a sleeping space for an infant, and it is useful for further improving conveniences of a user by enhancing the folding workability and safety thereof.

The invention claimed is:

1. Knockdown furniture for an infant, said furniture being transformable from a fully erect condition, to an intermediate folded condition and then to a fully folded condition, comprising:

a frame body that forms an accommodating space in which an infant is accommodated and that is placed on an installation surface, wherein the frame body includes a plurality of frame members, and a bottom plate arranged below the frame body in said fully erect condition, the plurality of frame members can be folded into a flat shape along the bottom plate in at least said fully folded condition, the bottom plate and the plurality of frame members folded into a flat shape along the bottom plate can be mutually and integrally folded, the plurality of frame members constituting the frame body include, in said fully erect condition, a plurality of vertical frames, an upper lateral frame arranged on upper portions of the plurality of vertical frames, and a lower lateral frame arranged on lower portions of the plurality of vertical frames, the upper lateral frame, the lower lateral frame, and the bottom plate are arranged substantially in parallel to each other in said fully erect condition, each of the plurality of vertical frames includes, in said fully erect condition, an upper main tube and a lower main tube arranged on a lower portion of the upper main tube, the vertical frame includes a first folding unit that is arranged between the upper main tube and the lower main tube that arranges the upper lateral frame, the lower lateral frame, and the bottom plate at positions close to each other while maintaining the upper lateral frame in a flat shape and maintaining the upper lateral frame, the lower lateral frame, and the bottom plate in parallel to each other by making it possible to fold the vertical frame into said fully folded condition, second folding units are provided at positions substantially corresponding to the upper lateral frame, the lower lateral frame, and the bottom plate, thereby making it possible to fold the upper lateral frame, the lower lateral frame, and the bottom plate substantially in the same direction when going from said erect condition to said folded condition, the upper lateral frame includes, in said fully erect condition, a left side frame portion, a right side frame portion and a central frame portion, arranged between and rotatably coupled to each of the left side frame portion and the right side frame portion, thereby constituting one of the second folding units, said right side frame portion and said left side frame portion being substantially equal in length, the upper lateral frame has a connecting portion at which the vertical frame is connected to the upper lateral frame, the vertical frame can be folded by the first folding unit so that the folded vertical frame and the connecting portion of the upper lateral frame can be parallel to each other in said intermediate folded conditions and said fully folded conditions, and the upper lateral frame, the lower lateral frame, and the bottom plate can be folded by the second folding units while maintaining the upper lateral frame, the lower lateral frame and, the bottom plate in parallel to each other so that (i) the central frame portion of the upper lateral frame can be parallel to the installation surface, and (ii) the upper main tube, the lower main tube, the left side frame portion, and the right side frame portion can be parallel to each other and orthogonal to the installation surface, in said fully folded condition.

2. The knockdown furniture for an infant according to claim 1, wherein the first folding unit of the vertical frame is arranged substantially at a central position of the vertical frame in its longitudinal direction.

3. The knockdown furniture for an infant according to claim 1, wherein the second folding unit of the lower lateral frame can be held from above, the second folding unit of the upper lateral frame and the second folding unit of the bottom plate are arranged above the second folding unit of the lower lateral frame, and thus the second folding unit of the lower lateral frame is brought up and folded, thereby making it possible to collectively folding the second folding unit of the upper lateral frame and the second folding unit of the bottom plate.

4. The knockdown furniture for an infant according to claim 3, wherein the bottom plate is formed with an opening that can open and close, the second folding unit of the lower lateral frame is arranged at a position below the opening, and the second folding unit of the lower lateral frame is held from above through the opening.

5. The knockdown furniture for an infant according to claim 1, wherein the second folding unit of the lower lateral frame is provided with an operating handle that folds the lower lateral frame and that holds the knockdown furniture for an infant in a folded state.

6. The knockdown furniture for an infant according to claim 1, wherein a bed plate on which an infant is laid down is detachably attached to the frame body.

7. The knockdown furniture for an infant according to claim 6, wherein the bed plate is provided with a protection cover that can surround an infant.

8. The knockdown furniture for an infant according to claim 1, wherein a bed plate on which an infant is laid down can be folded in a flat shape along the bottom plate.

9. The knockdown furniture for an infant according to claim 1, wherein rollers for moving the knockdown furniture for an infant are provided below the frame body.

10. The knockdown furniture for an infant according to claim 1, wherein the frame body is provided with a moving handle for pulling and rotating the knockdown furniture for an infant.

11. The knockdown furniture for an infant according to claim 10, wherein the moving handle is stored in the frame body such that the moving handle can be taken out from the frame body.

12. The knockdown furniture for an infant according to claim 10, wherein the moving handle can be detachable from the frame body.

13. The knockdown furniture for an infant according to claim 10, wherein the moving handle includes an extension and retraction mechanism that can extend and retract the moving handle.

* * * * *